US011709451B2

(12) United States Patent
Hashimoto

(10) Patent No.: US 11,709,451 B2
(45) Date of Patent: Jul. 25, 2023

(54) ROTATING TRANSPORT MEMBER WITH FLEXIBLE SECTION AND RIGID SECTION

(71) Applicant: FUJIFILM BUSINESS INNOVATION CORP., Tokyo (JP)

(72) Inventor: Keita Hashimoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/583,885

(22) Filed: Jan. 25, 2022

(65) Prior Publication Data

US 2023/0085461 A1 Mar. 16, 2023

(30) Foreign Application Priority Data

Sep. 14, 2021 (JP) ..... 2021-149094

(51) Int. Cl.
*G03G 21/10* (2006.01)
*G03G 21/00* (2006.01)

(52) U.S. Cl.
CPC ..... *G03G 21/105* (2013.01); *G03G 21/0011* (2013.01); *G03G 2221/001* (2013.01)

(58) Field of Classification Search
CPC ..... G03G 21/10; G03G 21/105
USPC ..... 399/358
See application file for complete search history.

(56) References Cited

U.S. PATENT DOCUMENTS 7,099,617 B2 8/2006 Jeong et al.
8,583,023 B2 * 11/2013 Yuasa ..... G03G 21/105 399/360
10,379,486 B2 * 8/2019 Ando et al. ..... G03G 21/105
2011/0305486 A1 * 12/2011 Ohgoshi et al. ... G03G 15/0875 399/358
2020/0301347 A1 9/2020 Ichikawa

FOREIGN PATENT DOCUMENTS

JP 2005-025207 A 1/2005
JP 2009-008852 A 1/2009
JP 2020-154199 A 9/2020

* cited by examiner

*Primary Examiner* — Gregory H Curran
(74) *Attorney, Agent, or Firm* — Oliff PLC

(57) ABSTRACT

A transporting member includes: a first transporting section that has flexibility and that has a first shaft and a blade existing helically on a surface of the first shaft and transporting a transport object; a second transporting section having a second shaft that extends from a first end of the first shaft and that has higher rigidity than the first shaft, and also having a coil that exists helically on a surface of the second shaft, is movable toward and away from the surface of the second shaft, and transports the transport object; and a drive section that is attached to an end of the second shaft opposite the first shaft or to a third shaft having higher rigidity than the first shaft by being connected to the end and that is driven by receiving a rotational force.

20 Claims, 19 Drawing Sheets

ROTATING TRANSPORT MEMBER WITH FLEXIBLE SECTION AND RIGID SECTION

CROSS-REFERENCE TO RELATED APPLICATIONS

This application is based on and claims priority under 35 USC 119 from Japanese Patent Application No. 2021-149094 filed Sep. 14, 2021.

BACKGROUND

(i) Technical Field

The present disclosure relates to transporting members, transporting devices, and image forming apparatuses.

(ii) Related Art

Japanese Unexamined Patent Application Publication No. 2020-154199 (claims 1 and 2, Paragraph 0045, FIGS. 2 to 5) describes an integrally-molded transporting member composed of an elastomer. This transporting member has a cross-sectionally-circular shaft and a helical blade that extends helically around the shaft and that rotates with the shaft to transport a transport object in the axial direction. In the transporting member, the helical blade includes multiple blades that are segmented by multiple slits provided at multiple locations in the circumferential direction and extending toward the shaft from an edge oriented away from the shaft. Moreover, a rotational force is input from a first end of the transporting member.

Japanese Unexamined Patent Application Publication No. 2009-8852 (claims 1 and 2, FIG. 3) describes a waste-toner transporting member that is disposed rotatably about an axis within a waste-toner transport path. The waste-toner transporting member includes a rotation shaft operatively linked with a driving source, a transporting screw axially supported by the rotation shaft, and an elastic member supported by the rotation shaft or the transporting screw. In the waste-toner transporting member, the elastic member is constituted of a coil spring extending through one region extending along the axis of the rotation shaft, and a rotational force is input from an end of the transporting screw opposite the elastic member.

Japanese Unexamined Patent Application Publication No. 2005-25207 (Paragraphs 0035 and 0037, FIG. 6) describes a waste-toner transporting member in which a helical blade on the outer periphery of a shaft includes an auger, a transporting coil joined to one end of the shaft, and an insertion member inserted in the transporting coil. In this transporting member, the insertion member is a rod-like member composed of a flexible material, such as rubber, and a rotational force is input from an end of the auger opposite the transporting coil.

SUMMARY

Aspects of non-limiting embodiments of the present disclosure relate to a transporting member including a first transporting section that has flexibility and has a first shaft and a blade existing helically on a surface of the first shaft, and also including a second transporting section that has a second shaft extending from a first end of the first transporting section and that also has a coil extending around the second shaft. In the transporting member, a rotational force may be efficiently transmitted to the first transporting section and the second transporting section, as compared with a case where the rotational force is input from the first transporting section. Aspects of non-limiting embodiments of the present disclosure also relate to a transporting device and an image forming apparatus that are equipped with the aforementioned transporting member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transporting member including: a first transporting section that has flexibility and has a first shaft and a blade existing helically on a surface of the first shaft and transporting a transport object; a second transporting section having a second shaft that extends from a first end of the first shaft and that has higher rigidity than the first shaft, and also having a coil that exists helically on a surface of the second shaft, is movable toward and away from the surface of the second shaft, and transports the transport object; and a drive section that is attached to an end of the second shaft opposite the first shaft or to a third shaft having higher rigidity than the first shaft by being connected to the end and that is driven by receiving a rotational force.

BRIEF DESCRIPTION OF THE DRAWINGS

Exemplary embodiments of the present disclosure will be described in detail based on the following figures, wherein.

and

Figure 19:
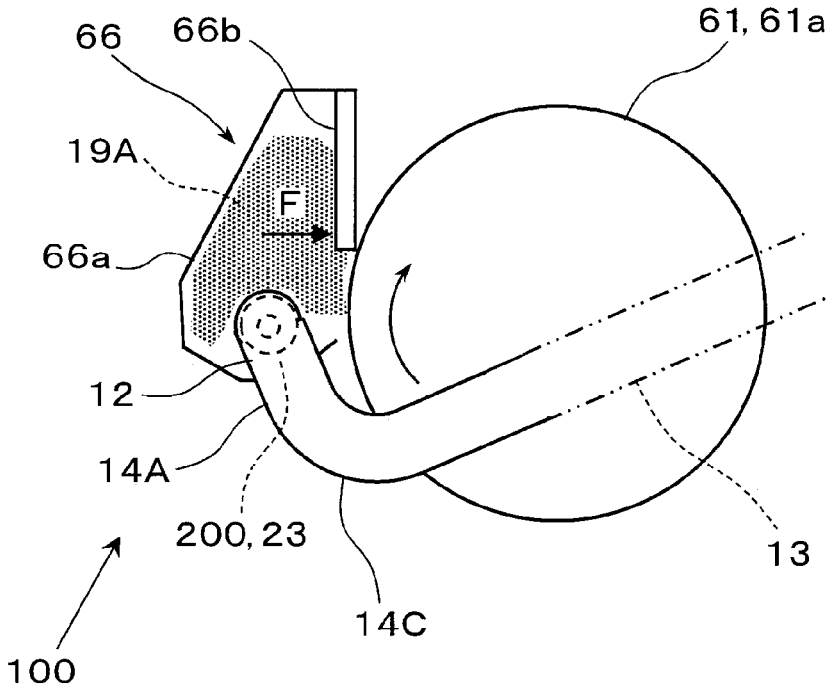

FIG. 19 schematically illustrates a problem occurring in a transporting device according to a comparative example.

DETAILED DESCRIPTION

Exemplary embodiments of the disclosure will now be described below with reference to the drawings.

First Exemplary Embodiment

Figure 1:
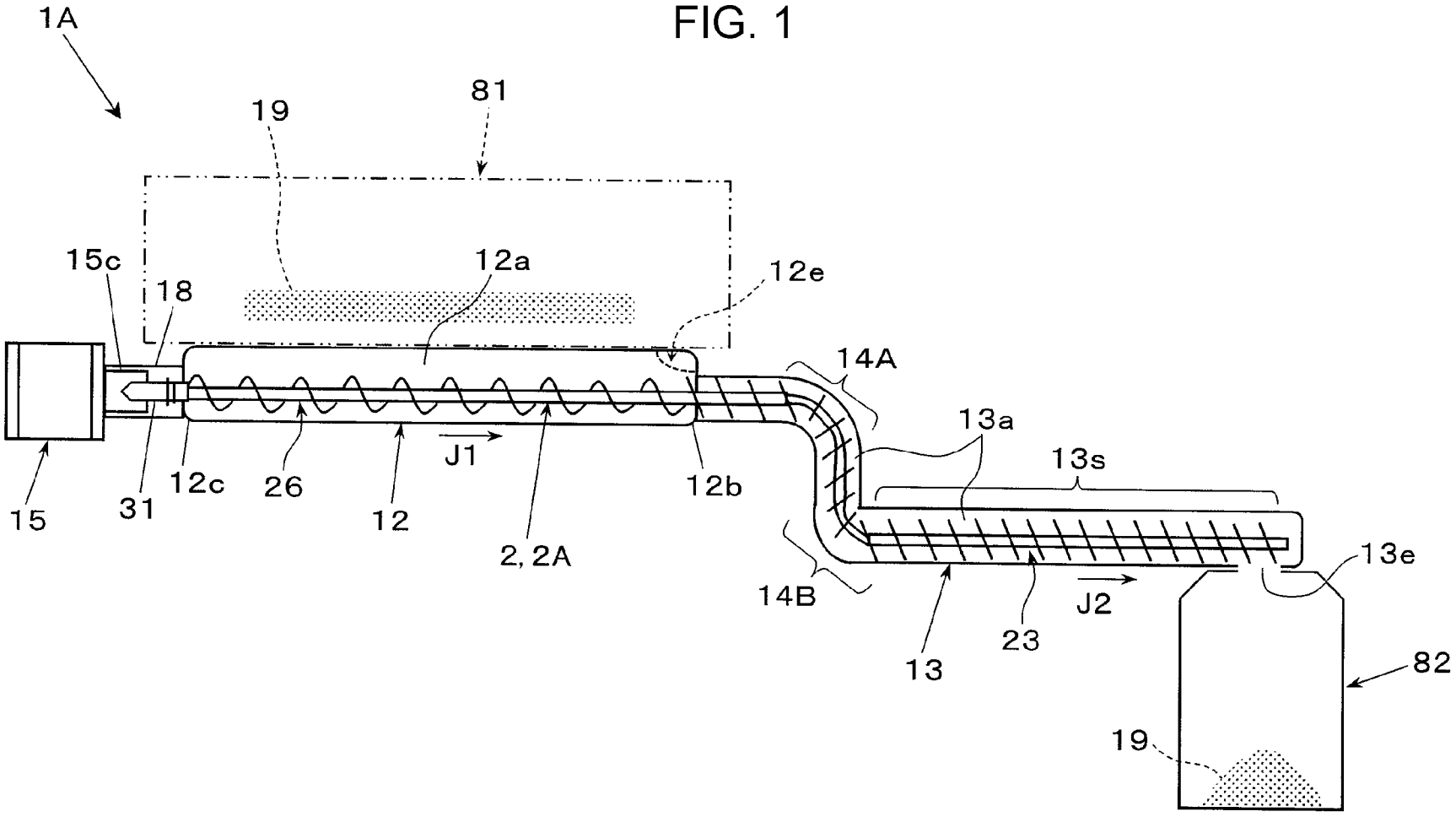
FIG. 1 schematically illustrates a transporting device according to a first exemplary embodiment.
Figure 2A:
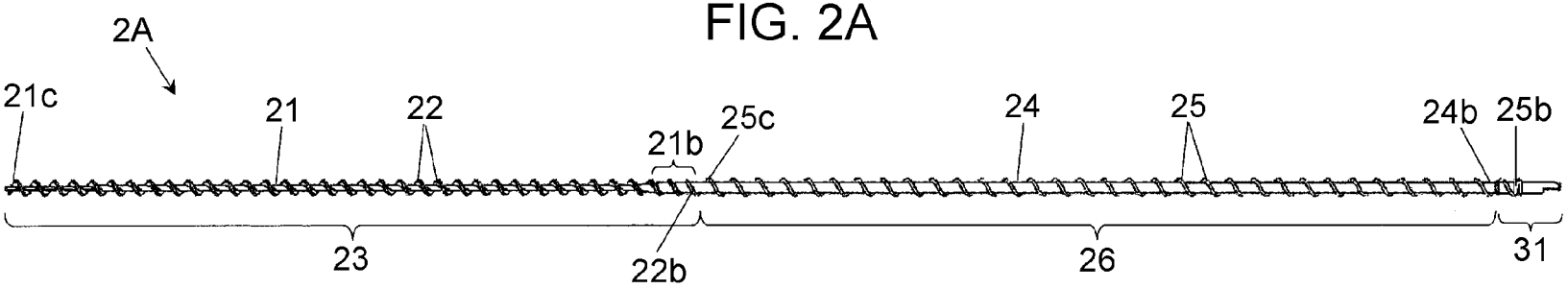
FIG. 2A is an external view of a transporting member according to the first exemplary embodiment.
Figure 2B:
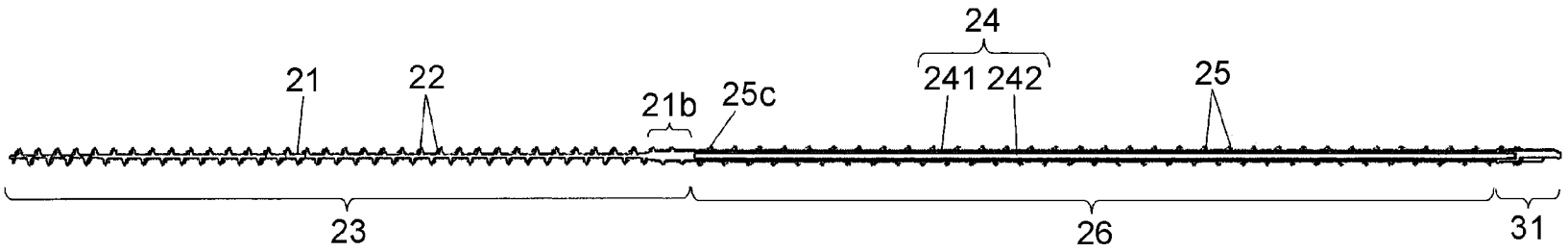
FIG. 2B is a cross-sectional view taken along an axis in FIG. 2A.

FIG. 1 schematically illustrates a transporting device 1A according to a first exemplary embodiment of the disclosure. FIGS. 2A and 2B are an external view and a cross-sectional view, respectively, of a transporting member 2A according to the first exemplary embodiment as an example of a transporting member 2 used in the transporting device 1A.

As shown in FIG. 1, the transporting device 1A includes a first transport passage 12, a second transport passage 13, the transporting member 2 that transports a transport object 19 at a transport source to a transport destination from the first transport passage 12 via the second transport passage 13, and a force transmitter 15 that transmits a rotational force to the transporting member 2.

The transport object 19 is an object transportable by the transporting member 2 and is, for example, a powder object constituted of a single kind of powder or particles or a mixture of powder or particles.

The first transport passage 12 is a passage in which a passage space 12*a* thereof extends linearly.

For example, the first transport passage 12 is a tubular passage in which the passage space 12*a* is substantially circular in cross section orthogonal to the transporting direction, or is a passage with a trough-like lower section in which the passage space 12*a* has a substantially semicircular cross-sectionally lower portion and a cross-sectionally upper portion with an upper opening. The external shape of the first transport passage 12 is not particularly limited so long as the passage space 12*a* has a predetermined shape.

The first transport passage 12 is provided in a structural body 81, such as a device or a container, serving as a transport source where the transport object 19 exists. In this case, the first transport passage 12 is provided inside an area where the transport object 19 is collected in the structural body 81, or is externally connected to the structural body 81.

Reference sign 12*e* shown in FIG. 1 denotes a guide surface provided within the passage space 12*a* of the first transport passage 12.

Because a passage space 13*a* of the second transport passage 13 has a cross-sectional area smaller than that of the passage space 12*a* of the first transport passage 12, the guide surface 12*e* serves as a guide for facilitating the introduction of the transport object 19, when transported by the transporting member 2, from the first transport passage 12 to the second transport passage 13. For example, the guide surface 12*e* has a curved surface as a guide surface that is curved to protrude downward gradually from a portion of the passage space 12*a* of the first transport passage 12 toward an upper portion of the passage space 13*a* of the second transport passage 13.

The second transport passage 13 has an opening connected to a first end 12*b* of the first transport passage 12, and has one or more bent passage portions 14A and 14B.

The second transport passage 13 is a tubular passage in which the passage space 13*a* is substantially circular or elliptical in cross section orthogonal to the transporting direction. The external shape of the second transport passage 13 is not particularly limited so long as the passage space 13*a* has a predetermined shape.

The second transport passage 13 according to the first exemplary embodiment has two bent passage portions 14A and 14B.

In the first bent passage portion 14A, the passage space 13*a* slightly extends substantially horizontally and linearly from the first end 12*b* of the first transport passage 12 and then bends downward with a predetermined curvature. In the second bent passage portion 14B, the passage space 13*a* extends slightly downward and linearly from the terminal end of the first bent passage portion 14A and then bends with a predetermined curvature substantially in the horizontal direction.

The second transport passage 13 according to the first exemplary embodiment has a linear passage portion 13*s* in which the passage space 13*a* extends substantially horizontally and linearly from the terminal end of the second bent passage portion 14B.

Furthermore, the second transport passage 13 is provided with an outlet 13*e* that discharges the transport object 19 transported to the terminal end of the linear passage portion 13*s*.

The transporting member 2 is disposed continuously through the first transport passage 12 and the second transport passage 13 and transports the transport object 19 in that state to a predetermined transport destination. For example, as shown in FIG. 1, the transport destination is a receptor 82, such as a container or a device, receiving the transport object 19.

In the transporting device 1A, the transporting member 2 used is, for example, a transporting member 2A having a configuration to be described below.

The force transmitter 15 transmits a rotational force to the transporting member 2 at an outer portion 18 of a second end 12*c* of the first transport passage 12.

The force transmitter 15 is constituted of a driving device, such as a motor (not shown), a drive transmission mechanism, such as a gear train (not shown), or an output shaft coupling 15*c*, such as a coupling. The force transmitter 15 outputs a rotational force to be used for rotating the transporting member 2 in a predetermined direction.

The force transmitter 15 may be integrated with the first transport passage 12 and the second transport passage 13, or may be provided separately from the first transport passage 12 and the second transport passage 13.

The force transmitter 15 is connected to a first end of the transporting member 2 by using the output shaft coupling 15*c* at the outer portion 18 of the second end 12*c* of the first transport passage 12. The outer portion 18 has a cylindrical space capable of accommodating the first end of the transporting member 2 and the output shaft coupling 15*c* of the force transmitter 15.

In a case where the force transmitter 15 is provided separately from the first transport passage 12 and the second transport passage 13, the force transmitter 15 may be readily connectable to the first end of the transporting member 2 in a detachable manner.

The transporting member 2A used in the transporting device 1A will now be described.

For example, as shown in FIGS. 1 to 2B, the transporting member 2A includes a first transporting section 23, a second transporting section 26, and a drive section 31.

For example, as shown in FIGS. 2A to 3B, the first transporting section 23 has a first shaft 21 and a blade 22 that exists helically on the surface of the first shaft 21 and that transports the transport object 19. Moreover, the first transporting section 23 entirely has flexibility.

The first shaft 21 is a rod-like shaft that is circular in cross section.

With regard to the first shaft 21, the shaft body thereof excluding a first end 21*b* located adjacent to the second transporting section 26 and a second end 21*c* located opposite the first end 21*b* has a narrow cylindrical shape. The first end 21*b* gradually increases in outer diameter. This will be described later. As shown in FIGS. 2A and 2B, the second end 21*c* has a tapered shape such that the outer diameter thereof gradually decreases.

The blade 22 extends helically at a predetermined pitch and a predetermined helix angle so as to exhibit a transporting function.

Figure 3A:
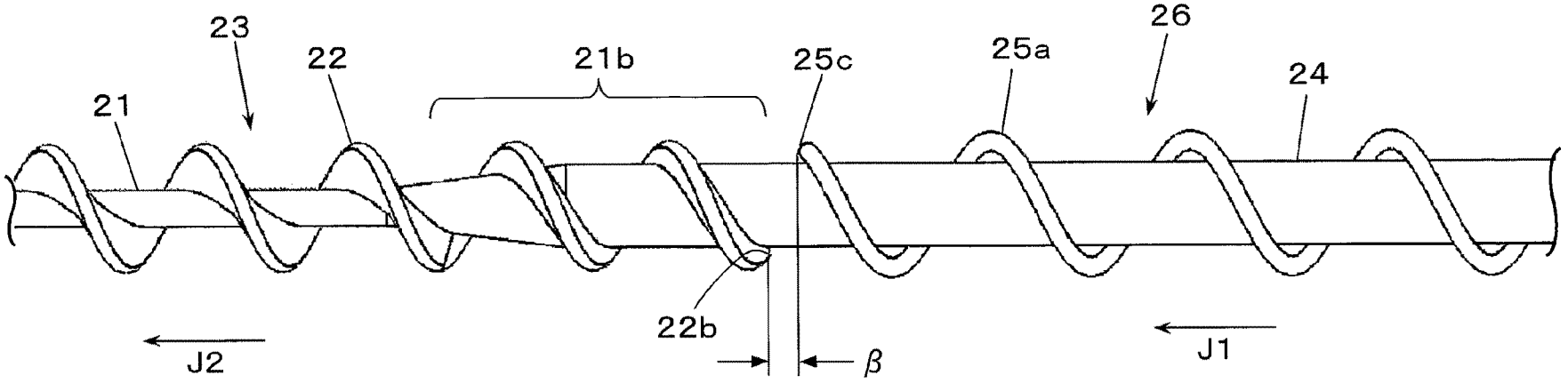
FIG. 3A is an external view of a part where a first transporting section and a second transporting section of the transporting member are connected.

The blade 22 protrudes to a predetermined height from the surface of the first shaft 21. The separation distance (i.e., a dimension corresponding to the outer diameter of the blade 22) between outermost portions of the blade 22 is compatible with a dimension of a passage space in a transport passage in which the first transporting section 23 is disposed. Furthermore, for example, as shown in FIG. 3A, when the transporting member 2A rotates in a predetermined direction, the blade 22 is configured such that the transporting direction for the transport object 19 is aligned with a direction indicated by an arrow J2.

The flexibility of the first transporting section 23 is obtained by using a material indicating predetermined flexible properties, that is, elastically deformable properties, for the first shaft 21 and the blade 22.

The predetermined flexibility allows the first transporting section 23 to be bent with a predetermined curvature and enables the blade 22 to obtain a transporting function by rotating about the first shaft 21 when the first transporting section 23 receives a rotational force in the bent state.

The first transporting section 23 according to the first exemplary embodiment is fabricated by molding synthetic resin (synthetic rubber) having elasticity, such as an elastomer.

For example, as shown in FIGS. 2A to 3B, the second transporting section 26 has a second shaft 24 and a coil 25 that transports the transport object 19 in a state where the coil 25 extends around the second shaft 24.

The second shaft 24 extends from the first end 21*b* of the first shaft 21 and has higher rigidity than the first shaft 21.

The expression "higher rigidity than the first shaft 21" refers to, for example, a degree of rigidity indicating a mechanical property that is less flexible or bendable than the first shaft 21. The high rigidity of the second shaft 24 similarly applies to rigidity higher than that of the first shaft 21 in areas other than the second shaft 24.

The rigidity of the second shaft 24 is obtained by using a material or structure or both thereof with different rigidity enhancing contents from a material or structure constituting the first shaft 21.

Figure 3B:
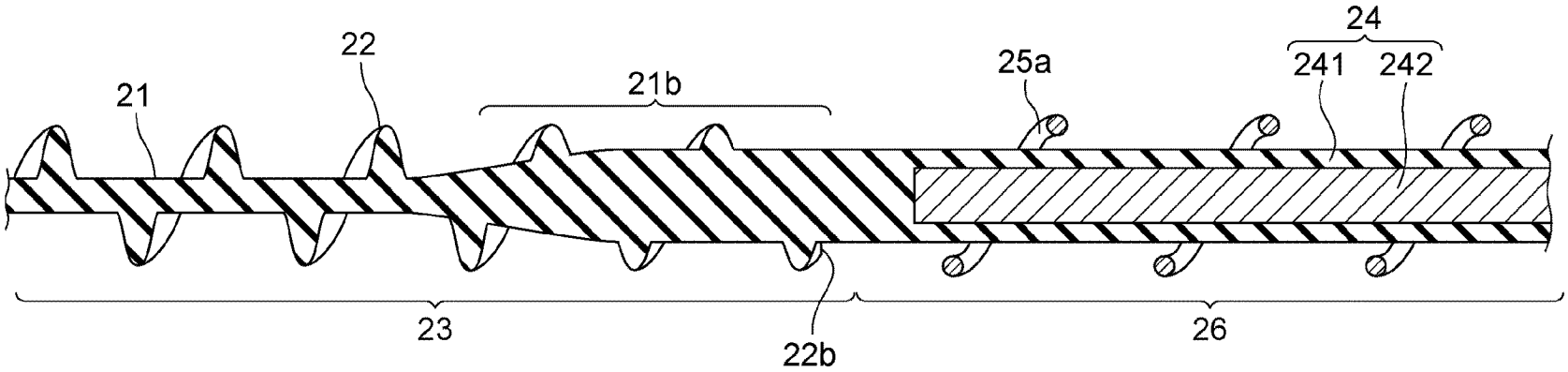
FIG. 3B is a cross-sectional view of the part in FIG. 3A.
Figure 4A:
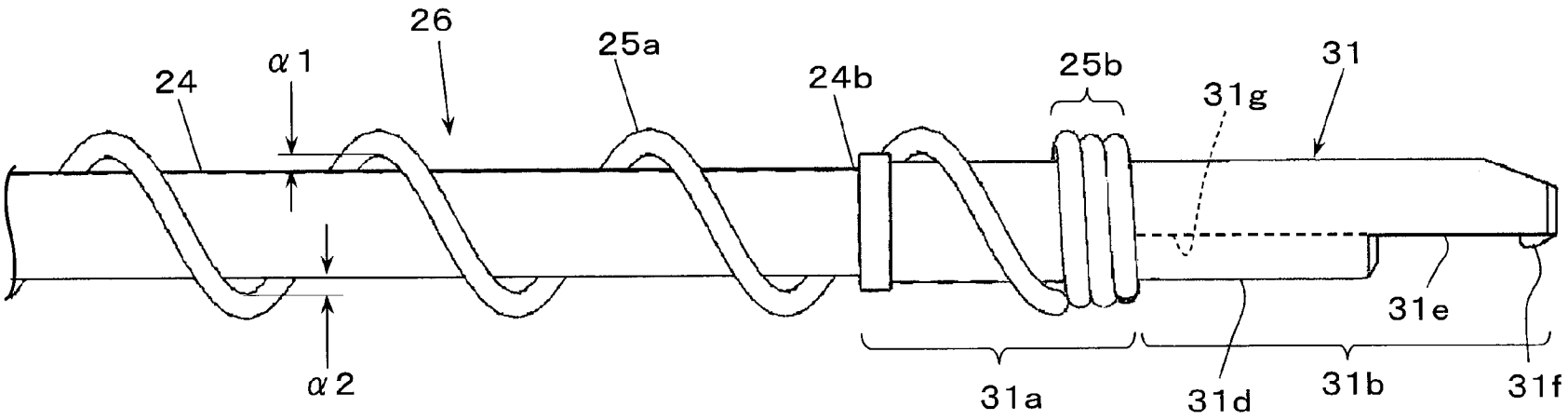
FIG. 4A is an external view of a part of the second transporting section and a drive section of the transporting member.
Figure 4B:
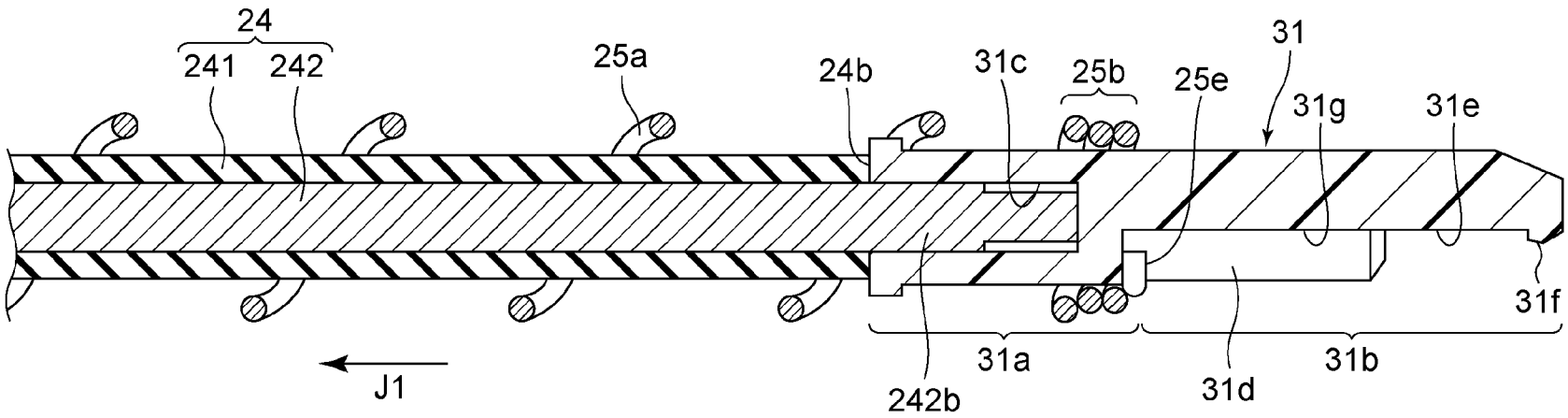
FIG. 4B is a cross-sectional view of FIG. 4A.

For example, as shown in FIGS. 2B, 3B, and 4B, the second shaft 24 according to the first exemplary embodiment is constituted of a surface layer 241 composed of the same material as the first transporting section 23 and a core 242 disposed inside the surface layer 241 and having higher rigidity than the first shaft 21.

With regard to this second shaft 24, the entire structure constituted of the combination of the surface layer 241 and the core 242 has higher rigidity than the first shaft 21.

Due to being composed of the same material as the first transporting section 23, the surface layer 241 has flexibility. Therefore, the surface layer 241 is integrally fabricated concurrently with the fabrication process of the first transporting section 23. Consequently, the second shaft 24 is joined to the first end 21*b* of the first shaft 21.

On the other hand, since the surface layer 241 alone does not provide the second shaft 24 with higher rigidity than the first shaft 21, the core 242 serves as a member that ensures rigidity. For example, the core 242 used is a rod-like member that is circular in cross section and that is composed of stainless steel (SUS).

The second shaft 24 having this core 242 is fabricated by, for example, insert molding.

For example, as shown in FIG. 4B, in the second shaft 24 according to the first exemplary embodiment, a first end 242*b* of the core 242 protrudes further beyond an edge of the surface layer 241 at an end 24*b* opposite the first shaft 21. This protruding first end 242*b* is to be used when the drive section 31 is to be attached, which will be described later.

Furthermore, due to being constituted of the surface layer 241 and the core 242, the second shaft 24 has an outer diameter that is larger than the outer diameter of the first shaft 21, as shown in, for example, FIGS. 3A to 4B. On the other hand, for example, as shown in FIG. 3B, with regard to the first shaft 21, the first end 21*b* thereof connected to the second shaft 24 has an outer diameter that gradually increases and then ultimately becomes equal to the outer diameter of the second shaft 24.

The coil 25 is a coil (i.e., coil spring) with a body 25*a* that extends at a predetermined pitch and a predetermined helix angle. Moreover, the coil 25 is configured such that the body 25*a* thereof is movable toward and away from the surface of the second shaft 24.

Figure 5A:
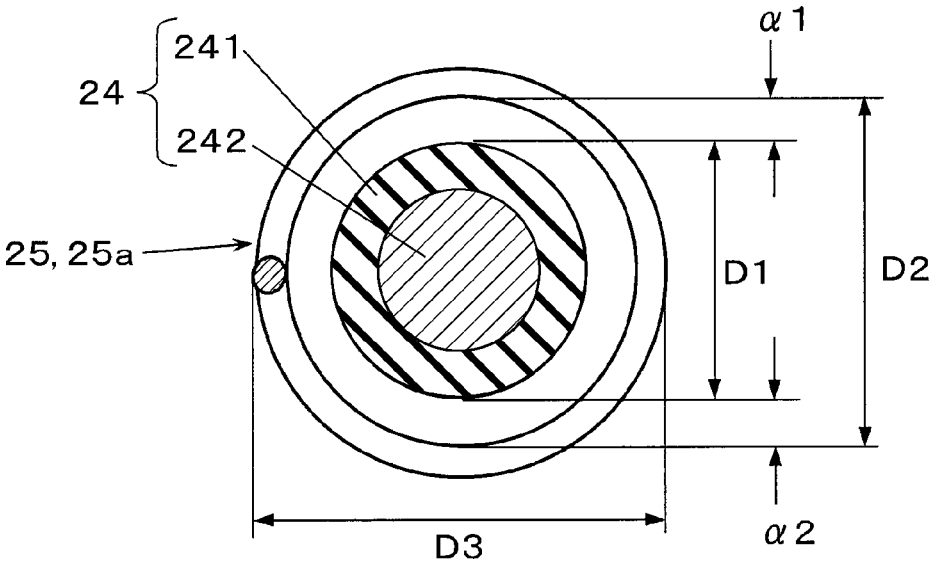
FIG. 5A is an external view of the part of the second transporting section and the drive section of the transporting member.

As shown in FIG. 5A, the body 25*a* of the coil 25 is disposed with predetermined gaps $\alpha 1$ and $\alpha 2$ from the surface of the second shaft 24, so that the body 25*a* is movable toward and away from the surface of the second shaft 24.

Figure 5B:
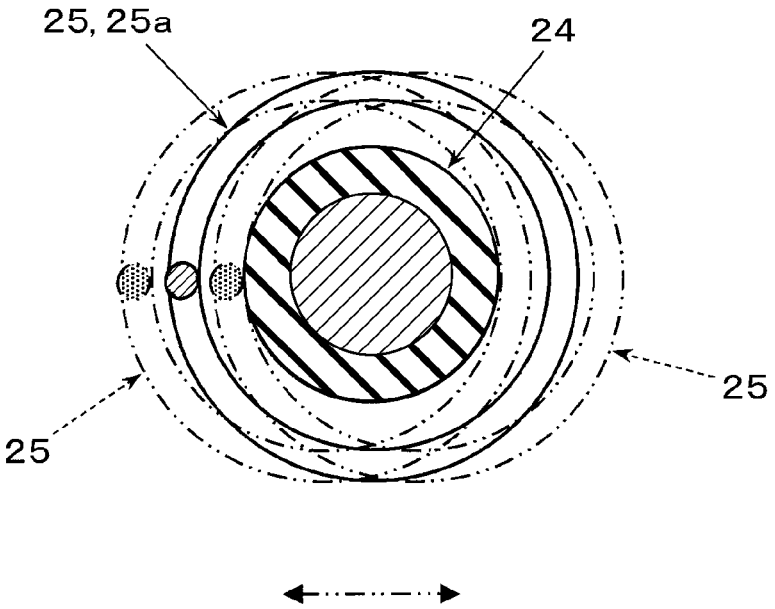
FIG. 5B is a cross-sectional view of FIG. 5A.

In detail, as indicated with double-dot chain lines in FIG. 5B, when the coil 25 rotates, the body 25*a* thereof is movable toward the surface of the second shaft 24 and is movable away from the surface of the second shaft 24. The coil 25 is not limited to the example of movement indicated with the double-dot chain lines in FIG. 5B, and is movable toward and away from the surface of the second shaft 24 along the entire circumference.

In other words, as shown in FIG. 5A, the coil 25 is configured such that the body 25*a* thereof is formed of the aforementioned coil, and has an inner coil diameter D2 that is larger than an outer diameter D1 of the second shaft 24.

As shown in FIG. 5A, since the coil 25 described above has a relationship in which the inner coil diameter D2 is larger than the outer diameter D1 of the second shaft 24, the body 25*a* is disposed with the predetermined gaps α1 and α2 from the surface of the second shaft 24.

The gaps α1 and α2 are set to substantially the same dimension along the entire outer periphery of the second shaft 24. For example, the dimension is substantially equal to (D2−D1)/2.

Furthermore, for example, the coil 25 is a metallic coil obtained by bending a cross-sectionally-circular rod-like member composed of stainless steel into a helical shape.

An outer diameter D3 of the coil 25 is compatible with a dimension of a passage space in a transport passage in which the second transporting section 26 is disposed.

Moreover, for example, as shown in FIGS. 3A and 4B, the coil 25 is configured such that, when the transporting member 2A rotates in a predetermined direction, the transporting direction for the transport object 19 is aligned with a direction indicated by an arrow J1.

The drive section 31 is where a rotational force from the force transmitter 15 is received first so as to be driven.

As shown in FIGS. 4A and 4B, the drive section 31 according to the first exemplary embodiment has a shaft 31*a* and a joint 31*b*.

The shaft 31*a* is a cylindrical portion attached concentrically with the second shaft 24 to an end 24*b* of the second shaft 24 opposite the first shaft 21. The shaft 31*a* is provided with a shaft connection hole 31*c* at the end adjacent to the second shaft 24.

The shaft connection hole 31*c* in the shaft 31*a* receives the first end 242*b* of the core 242 in the second shaft 24, so that the shaft 31*a* is joined to the end 24*b* of the second shaft 24.

As shown in FIGS. 4A and 4B, the joint 31*b* is constituted of a body portion 31*d* and a lock portion 31*e*.

The body portion 31*d* is a cylindrical portion extending continuously from the shaft 31*a*.

The body portion 31*d* is provided with a groove 31*g* extending from the lock portion 31*e* toward the shaft 31*a*. The groove 31*g* is to be used for receiving and retaining a terminal end 25*e* at a first end 25*b*, to be described later, of the coil 25.

The lock portion 31*e* has a cross-sectional shape that resembles the character D, as viewed from the end of the body portion 31*d* opposite the shaft 31*a*. When the lock portion 31*e* is connected to the force transmitter 15, the lock portion 31*e* engages with the output shaft coupling 15*c* of the force transmitter 15 and thus becomes capable of receiving a rotational force from the force transmitter 15.

The lock portion 31*e* is provided with a hooking protrusion 31*f* at the tapered terminal end thereof. The hooking protrusion 31*f* is to be used for coupling with the output shaft coupling 15*c* in the force transmitter 15, which will be described later.

The drive section 31 entirely has higher rigidity than the first shaft 21.

The drive section 31 according to the first exemplary embodiment is fabricated by molding using synthetic resin, such as a polycarbonate (PC) or an acrylonitrile butadiene styrene copolymer (ABS).

In the transporting member 2A, the coil 25 in the second transporting section 26 is disposed to surround the second shaft 24. For example, as shown in FIGS. 2A and 2B and FIGS. 4A and 4B, the coil 25 is attached in a state where the first end 25*b* opposite the first transporting section 23 is secured to the drive section 31.

In the first exemplary embodiment, the coil 25 is attached in a wound state where the first end 25*b* thereof is reduced in diameter by being wound multiple times around the shaft 31*a* of the drive section 31. In this state, the terminal end 25*e* of the first end 25*b* is secured by being fitted and retained in the groove 31*g* in the shaft 31*a*.

As shown in FIG. 3A, in the second transporting section 26 of the transporting member 2A, a second end 25*c* of the coil 25 located adjacent to the first transporting section 23 is not secured to the second shaft 24. In other words, the second end 25*c* of the coil 25 is a free end.

Furthermore, as shown in FIG. 3A, in the transporting member 2A, the second end 25*c* of the coil 25 is disposed out of contact with an upstream end 22*b*, in the transporting direction J2, of the blade 22 in the first transporting section 23.

In the first exemplary embodiment, the second end 25*c* of the coil 25 is disposed away from the upstream end 22*b* of the blade 22 in the axial direction by a separation distance β. From the standpoint of reducing an interruption of a transporting force for the transport object 19, the separation distance β in this case may be smaller than the helical pitch of the coil 25 or the helical pitch of the blade 22.

Figure 6:
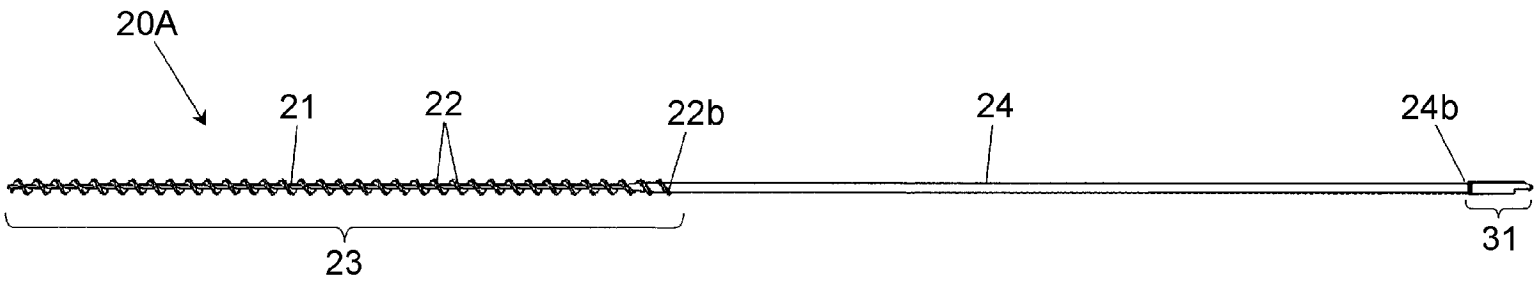
FIG. 6 is an external view of another transporting member according to the first exemplary embodiment.

FIG. 6 illustrates a transporting member 20A that may be used for fabricating the transporting member 2A.

The transporting member 20A is obtained by removing the coil 25 from the transporting member 2A.

Specifically, the transporting member 20A includes the first transporting section 23 having the first shaft 21 and the blade 22 and also having flexibility, the second shaft 24 having higher rigidity than the first shaft 21, and the drive section 31 attached to the end 24*b* of the second shaft 24 opposite the first shaft 21.

In this case, the first shaft 21, the blade 22, the second shaft 24, and the drive section 31 in the transporting member 20A are identical to the first shaft 21, the blade 22, the second shaft 24, and the drive section 31 in the transporting member 2A described above.

The transporting member 20A may be used for fabricating the transporting member 2A by attaching the coil 25 of the transporting member 20A around the second shaft 24. Therefore, the transporting member 20A may be regarded as an intermediate product used for fabricating the transporting member 2A.

The transporting member 20A may also be used as a normal transporting member that utilizes the transporting force of the first transporting section 23.

As shown in FIG. 1, the transporting member 2A having the above-described configuration is used by being disposed in the transporting device 1A.

In this case, the transporting member 2A is used by disposing the second transporting section 26 in the first transport passage 12 of the transporting device 1A and disposing the first transporting section 23 in the second transport passage 13 of the transporting device 1A.

In order to achieve this, the second transporting section 26 of the transporting member 2A is given a size suitable for being disposed within the passage space 12*a* of the first transport passage 12. Moreover, the first transporting section 23 of the transporting member 2A is given a size suitable for being disposed within the passage space 13*a* of the second transport passage 13.

Furthermore, as shown in FIG. 1, the first transporting section 23 of the transporting member 2A is disposed within the two bent passage portions 14A and 14B.

In the transporting member 2A, the first transporting section 23 having flexibility is disposed in a bent state to conform to the passage space 13*a* having a bent shape in the two bent passage portions 14A and 14B.

Moreover, the transporting member 2A is used by joining the drive section 31 to the output shaft coupling 15*c* of the force transmitter 15 in the transporting device 1A at the outer portion 18 of the second end 12*c* of the first transport passage 12.

In this case, the drive section 31 is disposed in a state where substantially the entire drive section 31 is accommodated in the outer portion 18 at the second end 12*c* of the first transport passage 12. In this state, the drive section 31 is joined by connecting the joint 31*b* to the output shaft coupling 15*c* of the force transmitter 15 and engaging the lock portion 31*e* of the joint 31*b* with a locking portion (not shown) of the output shaft coupling 15*c*.

When the transport object 19 is to be transported in the transporting device 1A, the force transmitter 15 is actuated.

Accordingly, in the transporting device 1A, a rotational force acting in a predetermined direction is input from the force transmitter 15 to the transporting member 2A via the drive section 31. Consequently, in the transporting member 2A, the drive section 31 starts to rotate in accordance with the rotational force. In addition, the rotational force is transmitted from the drive section 31 to the second shaft 24 of the second transporting section 26, and is subsequently transmitted from the second shaft 24 to the first shaft 21 of the first transporting section 23.

As a result, in the transporting device 1A, the transporting member 2A starts to rotate in the predetermined direction, and at the same time, the first transporting section 23 and the second transporting section 26 start to transport the transport object 19.

Specifically, as shown in FIG. 1, in the transporting device 1A, the transport object 19 existing in the structural body 81 serving as a transport source is transported through the first transport passage 12 in the transporting direction J1 by the second transporting section 26 of the transporting member 2A, and is ultimately delivered toward the second transport passage 13. Moreover, in the transporting device 1A, the transport object 19 delivered from the first transport passage 12 is transported through the second transport passage 13 in the transporting direction J2 by the first transporting section 23 of the transporting member 2A.

Finally, in the transporting device 1A, the transport object 19 transported by the first transporting section 23 is delivered from the outlet 13*e* located at the terminal end of the second transport passage 13 so as to be accommodated in the receptor 82.

In this case, in the transporting member 2A, the rotational force input from the drive section 31 is transmitted from the drive section 31 to the second shaft 24 having higher rigidity than the first shaft 21, and is subsequently transmitted from the second shaft 24 to the first shaft 21 having flexibility.

Therefore, in the transporting member 2A, the rotational force may be efficiently transmitted to the first transporting section 23 and the second transporting section 26, as compared with a case where the rotational force is input from the first shaft 21 of the first transporting section 23.

Furthermore, in this case, in the transporting member 2A, the first transporting section 23 receiving the rotational force rotates within the passage space 13*a* in the two bent passage portions 14A and 14B of the second transport passage 13.

Because the rotational force is also efficiently transmitted to the first transporting section 23, the transporting member 2A rotates in a state where the first shaft 21 having flexibility in the first transporting section 23 is bent, and also rotates while the blade 22 having flexibility elastically deforms to conform to the bent first shaft 21.

Therefore, in the transporting device 1A, the rotational force input from the drive section 31 may be efficiently transmitted to the first transporting section 23 and the second transporting section 26 of the transporting member 2A, so that transporting forces may be favorably obtained by the first transporting section 23 and the second transporting section 26, whereby a stable transporting force of the transporting member 2A may be obtained. Consequently, the transport object 19 may be favorably transported from the transport source toward the transport destination.

Furthermore, in the transporting device 1A, the coil 25 in the second transporting section 26 of the transporting member 2A is attached in a state where the first end 25*b* is secured while the second end 25*c* is not secured.

Consequently, in the transporting device 1A, the rotational force input to the drive section 31 is immediately transmitted to the coil 25 via the first end 25*b* of the coil 25, as compared with a case where the first end 25*b* of the coil 25 in the second transporting section 26 is secured to a section other than the drive section 31. Thus, in the transporting device 1A, the rotational force may be efficiently transmitted not only to the second transporting section 26 of the transporting member 2A but also to the first transporting section 23.

As shown in FIG. 5B, in the transporting device 1A, the body 25*a* of the coil 25 readily moves toward and away from the surface of the second shaft 24 within the passage space 12*a* of the first transport passage 12, as compared with a case where the second end 25*c* of the coil 25 in the second transporting section 26 is secured to, for example, the second shaft 24. Thus, in the transporting device 1A, the transport object 19 may be readily vibrated in accordance with the movement of the coil 25 of the second transporting section 26 within the passage space 12*a*.

Therefore, in a case where the transport object 19 is, for example, an object that tends to aggregate easily, like a powder object, the transport object 19 that may possibly aggregate within the passage space 12*a* of the first transport passage 12 may be transported while being crumbled by vibration occurring with the movement of the coil 25 of the second transporting section 26. As a result, in the transporting device 1A, the transport object 19 may be favorably transported through the first transport passage 12.

Furthermore, in the transporting device 1A, the first end 25*b* of the coil 25 of the transporting member 2A is secured to the drive section 31 at the outer portion 18 of the second end 12*c* of the first transport passage 12.

Accordingly, in the transporting device 1A, the body 25*a* of the coil 25 may readily move toward and away from the second shaft 24, as compared with a case where the first end 25*b* of the coil 25 of the transporting member 2A is secured to the drive section 31 within the passage space 12*a* of the first transport passage 12. Specifically, in this case, the body 25*a* of the coil 25 is movable around the second shaft 24 toward and away therefrom within the passage space 12*a* of the first transport passage 12 in a state where the first end 25*b* secured to the drive section 31 at the outer portion 18 of the second end 12*c* of the first transport passage 12 acts as a supporting point.

As a result, in the transporting device 1A, the transport object 19 may be readily vibrated within the first transport passage 12 by the coil 25 of the second transporting section 26 of the transporting member 2A, whereby a stable transporting force may be obtained particularly within the first transport passage 12.

As shown in FIG. 4A, in the transporting device 1A, the second end 25*c* of the coil 25 of the transporting member 2A is disposed out of contact with the upstream end 22*b* of the blade 22 in the first transporting section 23.

Accordingly, in the transporting device 1A, a hindrance to the movement of the coil 25 toward and away from the surface of the second shaft 24 as a result of the second end 25*c* coming into contact with the upstream end 22*b* of the blade 22 may be prevented, as compared with a case where the second end 25*c* of the coil 25 is in contact with the upstream end 22*b* of the blade 22.

As a result, in the transporting device 1A, the transport object 19 may be readily vibrated by the coil 25 of the second transporting section 26 of the transporting member 2A, whereby a stable transporting force may be obtained particularly within the first transport passage 12.

Furthermore, in the transporting device 1A, the second shaft 24 in the second transporting section 26 of the transporting member 2A is constituted of the surface layer 241 composed of the same material as the first transporting section 23 and the core 242 having higher rigidity than the first shaft 21.

Accordingly, in the transporting device 1A, the second shaft 24 may rotate stably without much wobbling, as compared with a case where the second shaft 24 does not have the core 242 having higher rigidity than the first shaft 21 particularly inside the second shaft 24. In addition, the possibility of the coil 25 moving too much within the passage space 13*a* of the second transport passage 13 and colliding with the inner wall of the passage space 13*a* due to wobbling of the second shaft 24 may be reduced.

As a result, in the transporting device 1A, the second transporting section 26 in the second transport passage 13 may achieve a stable transporting state.

Second Exemplary Embodiment

Figure 7:
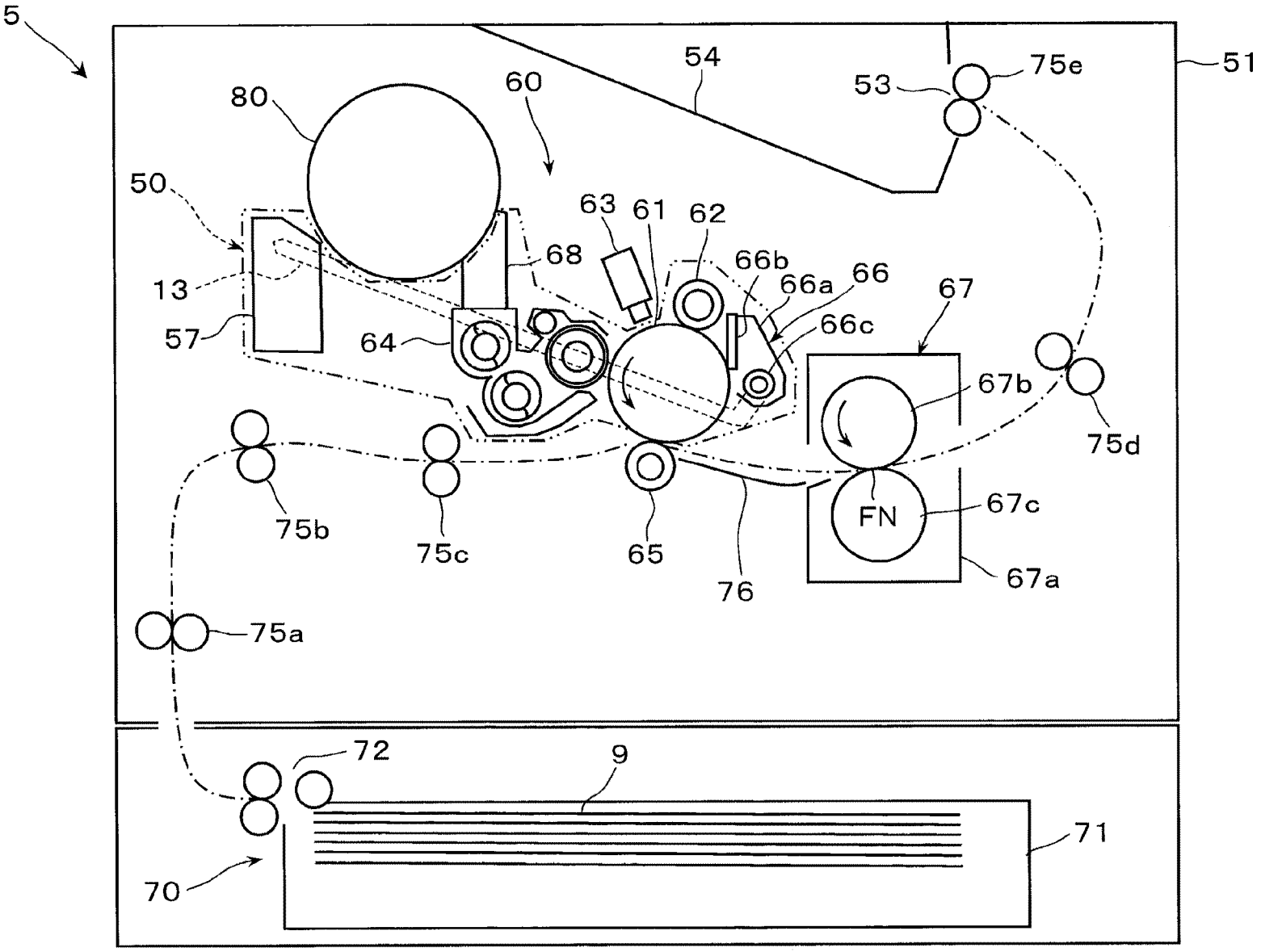
FIG. 7 schematically illustrates an image forming apparatus according to a second exemplary embodiment.
Figure 8:
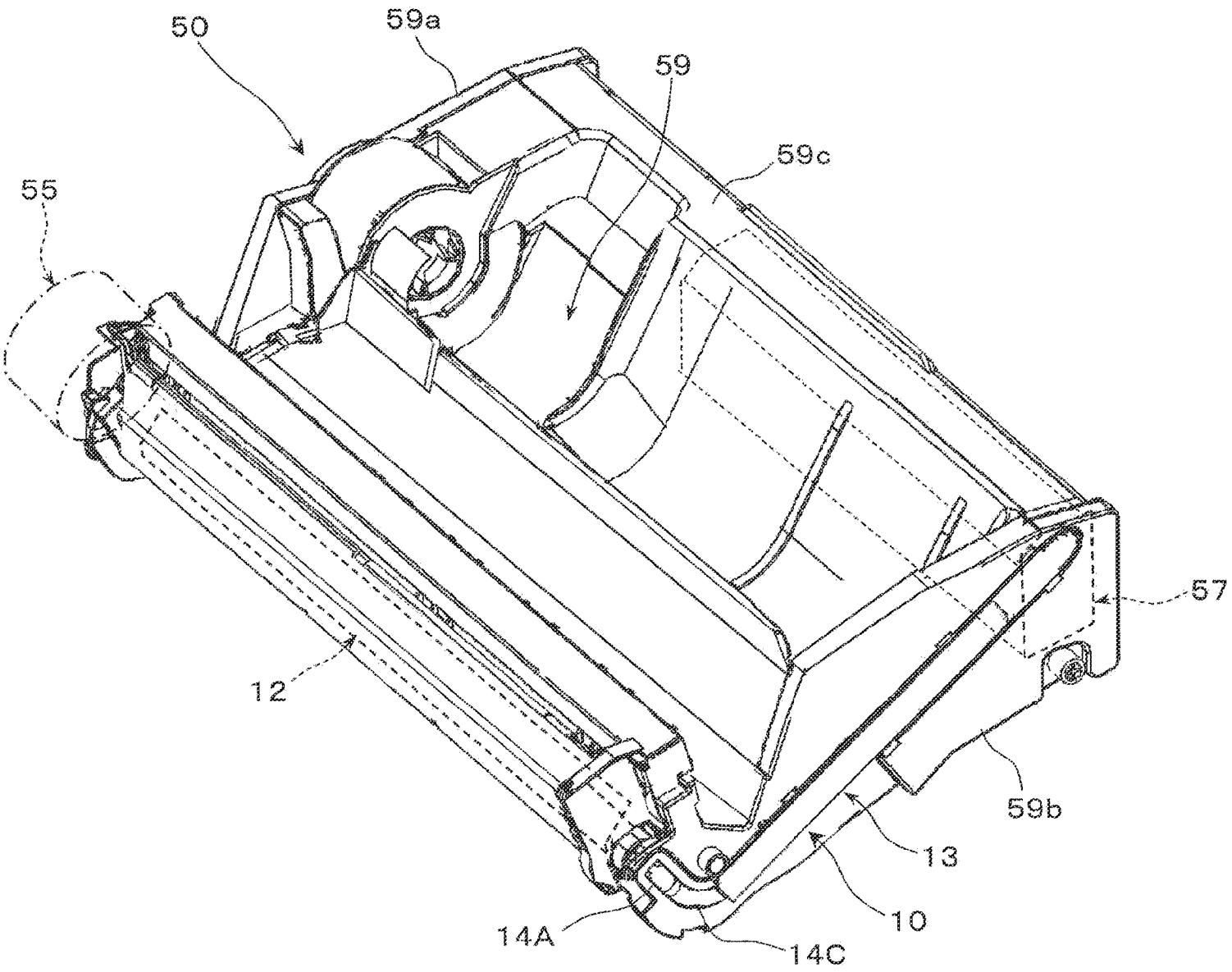
FIG. 8 is a perspective view of an image forming unit in the image forming apparatus in FIG. 7.

FIG. 7 schematically illustrates an image forming apparatus 5 according to a second exemplary embodiment of the disclosure. FIG. 8 schematically illustrates a detachable image forming unit 50 in the image forming apparatus 5.

As shown in FIG. 7, the image forming apparatus 5 has a housing 51 with devices disposed in the interior space thereof. Examples of the devices include an image forming section 60 that forms an image composed of a developer onto a sheet-like object 9 and a feeder 70 that accommodates the sheet-like object 9 and feeds the sheet-like object 9 to the image forming section 60.

The housing 51 is a box-shaped structural body having a predetermined external shape, and is provided with an output container 54 having an outlet 53 for the sheet-like object 9. The output container 54 is provided at an upper portion of the housing 51.

The image forming section 60 is configured to form an image by using, for example, electrophotography.

As shown in FIG. 7, the image forming section 60 has a photoconductor drum 61 supported in a rotatable manner in a direction indicated by an arrow. The photoconductor drum 61 is surrounded by devices, such as a charging device 62, an exposure device 63, a developing device 64, a transfer device 65, and a cleaning device 66. The image forming section 60 also has a fixing device 67 disposed at a position located away from the photoconductor drum 61.

The photoconductor drum 61 is an example of a structural body and an image bearing member having a bearing surface 61*a* (see FIG. 9A) as a surface that retains an image composed of a developer (i.e., toner).

The charging device 62 electrostatically charges the bearing surface 61*a* of the photoconductor drum 61. The exposure device 63 forms an electrostatic latent image by exposing the electrostatically-charged bearing surface 61*a* of the photoconductor drum 61 to light based on image information input to the image forming apparatus 5.

The developing device 64 develops the electrostatic latent image formed on the bearing surface 61*a* of the photoconductor drum 61 by using a developer so as to form a toner image. The developing device 64 is resupplied with an amount of developer (i.e., toner) according to the consumed amount of developer from a developer container 80 via a supplier 68.

The transfer device 65 transfers the toner image formed on the bearing surface 61*a* of the photoconductor drum 61 onto the sheet-like object 9.

The cleaning device 66 cleans the bearing surface 61*a* by removing excess toner from the bearing surface 61*a* of the photoconductor drum 61 after having passed through the transfer device 65.

The cleaning device 66 includes, for example, a housing 66*a*, a contact member 66*b*, and a delivery member 66*c*. The housing 66*a* has an opening facing the bearing surface 61*a* of the photoconductor drum 61, an accommodation space for accommodating the removed excess toner, and a linear discharge transport passage for transporting the accommodated excess toner outward. The contact member 66*b* is a plate-like member that partially blocks the opening of the housing 66*a* and is in contact with the bearing surface 61*a* of the photoconductor drum 61 to remove the excess toner from the bearing surface 61*a*. The delivery member 66*c* is used for delivering the excess toner removed by the contact member 66*b* and accommodated inside the housing 66*a* outward.

The image forming section 60 has a collection container 57 as an example of a container that accommodates the excess toner removed by the cleaning device 66.

The fixing device 67 fixes the unfixed toner image transferred on the sheet-like object 9 onto the sheet-like object 9 by applying heat and pressure to the unfixed toner image.

The fixing device 67 has a housing 67*a* having an inlet and an outlet for the sheet-like object 9. The housing 67*a* contains devices disposed in the interior space thereof. Examples of the devices include a heating rotating member 67*b* and a pressing rotating member 67*c*. The heating rotating member 67*b* and the pressing rotating member 67*c* are of a predetermined type, such as a roll-nip type or a belt-nip type.

The feeder 70 includes, for example, a container 71 that accommodates the sheet-like object 9 and a delivery device 72 that delivers the sheet-like object 9 accommodated in the container 71 at a predetermined timing. Each of the container 71 and the delivery device 72 provided is not limited to a single unit and may alternatively be multiple units.

A single-dot chain line in FIG. 7 denotes a transport passage used when the sheet-like object 9 is transported within the housing 51. The transport passage has arranged therein multiple pairs of transporting rollers 75*a* to 75*e* and a transporting guide member 76. The sheet-like object 9 is not particularly limited in terms of material and type, so long as the sheet-like object 9 is a sheet-like material that is transportable within the housing 51 and onto which a toner image is transferrable and fixable.

In the image forming apparatus 5, for example, an image forming operation is performed as follows.

First, in the image forming apparatus 5, when a controller (not shown) receives a command for an image forming operation, the image forming section 60 executes a charging operation, an exposure operation, a developing operation, and a transfer operation. Moreover, in the image forming apparatus 5, the feeder 70 executes an operation for delivering the sheet-like object 9 and feeding the sheet-like object 9 to a transfer position in the image forming section 60 via the transport passage.

Accordingly, in the image forming section 60, a toner image composed of a developer (i.e., toner) is formed on the bearing surface 61*a* of the photoconductor drum 61, and the toner image is subsequently transferred onto the sheet-like object 9 fed from the feeder 70. The sheet-like object 9 having the toner image transferred thereon is delivered toward the fixing device 67.

Then, in the image forming apparatus 5, the fixing device 67 of the image forming section 60 executes a fixing operation. Consequently, in the fixing device 67, the sheet-like object 9 having the toner image transferred thereon is introduced to and passed through an area where the heating rotating member 67*b* and the pressing rotating member 67*c* rotating in the direction indicated by the arrow are in contact with each other, whereby the sheet-like object 9 is heated and pressed. As a result, the toner image is fixed onto the sheet-like object 9.

Finally, in the image forming apparatus 5, the sheet-like object 9 having undergone the fixing operation is transported from the fixing device 67 to the outlet 53 via the transport passage, and is subsequently delivered to the output container 54 by the pair of transporting rollers 75*e*, whereby the sheet-like object 9 is accommodated in the output container 54.

As shown in FIGS. 7 and 8, in the image forming apparatus 5, the photoconductor drum 61, the charging device 62, the cleaning device 66, the supplier 68, and the collection container 57 of the image forming section 60 are integrated into a single detachable image forming unit 50.

The image forming unit 50 has a housing 59 constituted of left and right side surfaces 59*a* and 59*b* and a body 59*c* disposed between the left and right side surfaces 59*a* and 59*b*. The image forming unit 50 has devices including the photoconductor drum 61, the charging device 62, the cleaning device 66, the supplier 68, and the collection container 57 disposed inside the housing 59.

The image forming unit 50 is detachably attached to an attachment section (not shown) provided in the housing 51.

Figure 9A:
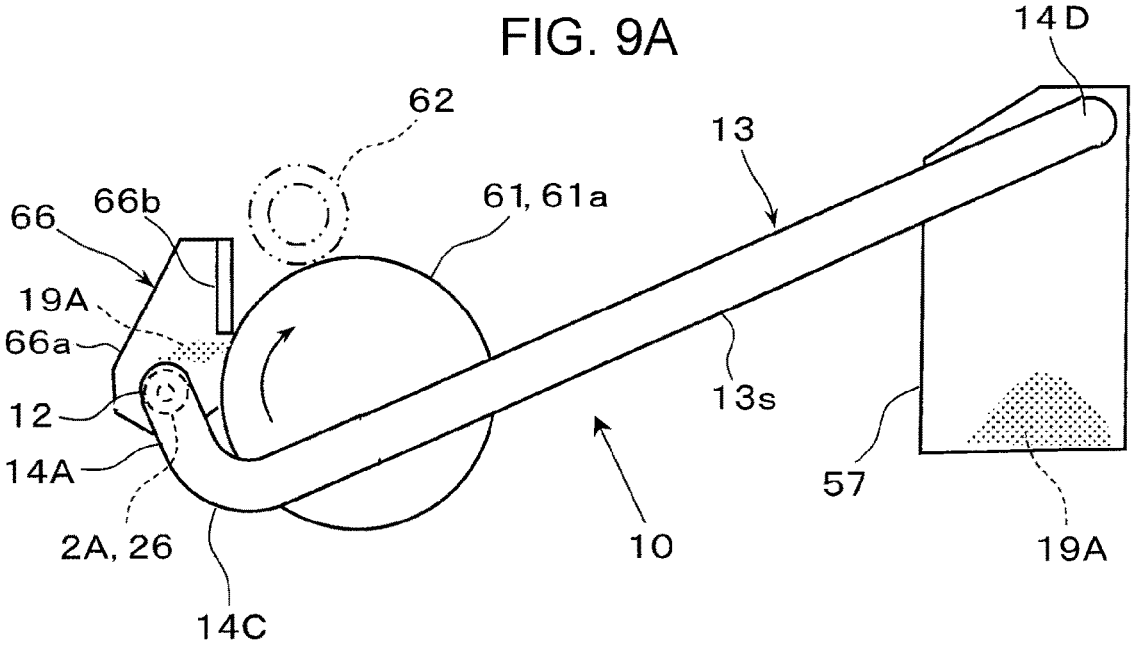
FIG. 9A is a side view schematically illustrating a transporting device according to the second exemplary embodiment.
Figure 9B:
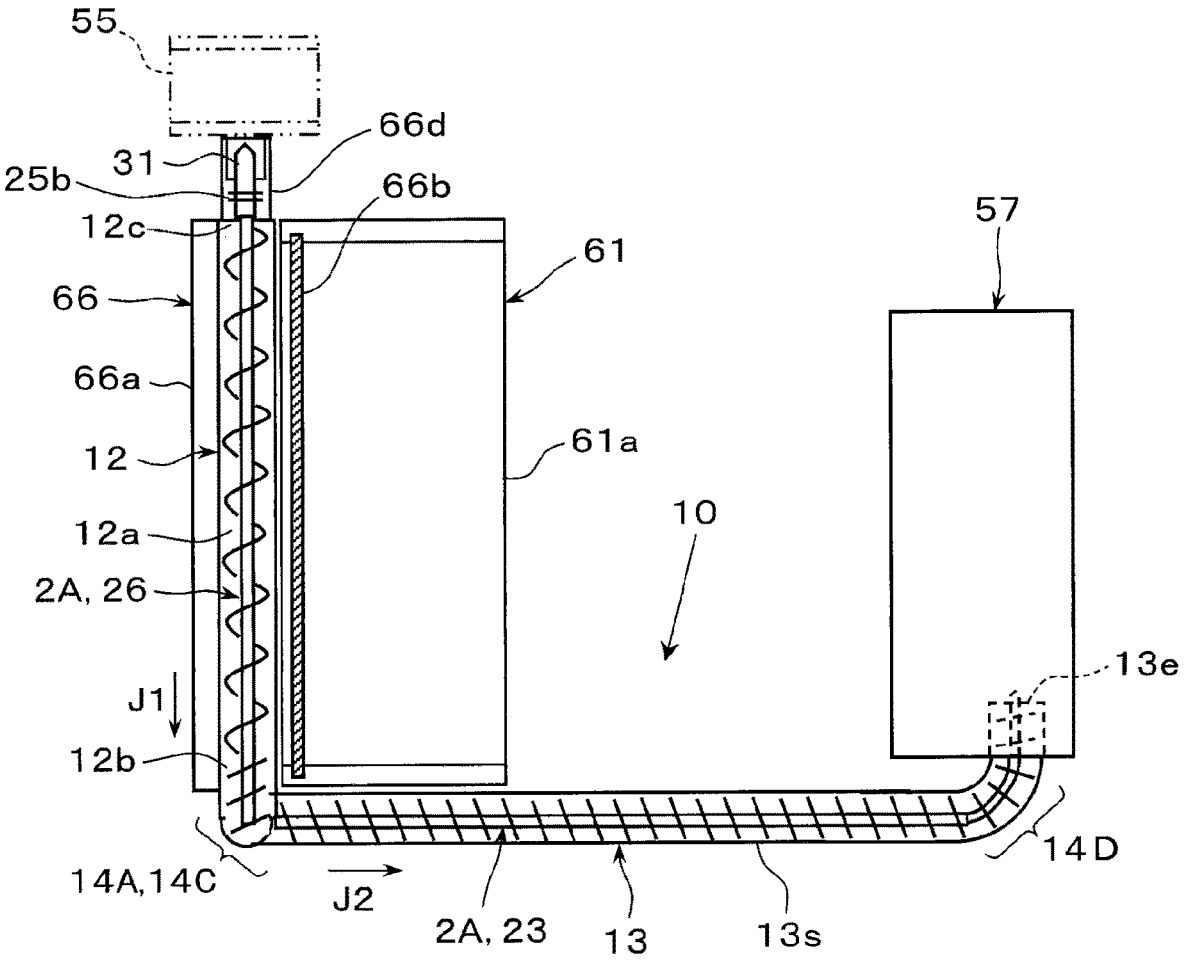
FIG. 9B is a plan view schematically illustrating the transporting device in FIG. 9A.

As shown in FIGS. 8 to 9B, the image forming unit 50 includes a transporting device 10 that transports a transport object 19A (see FIG. 9A), such as the excess toner removed by the cleaning device 66, to the collection container 57.

The transporting device 10 is different from the transporting device 1A according to the first exemplary embodiment in that the first transport passage 12 is disposed within a housing 66*a* of the cleaning device 66 and that the second transport passage 13 has a partially different configuration, but is similar to the transporting device 1A with regard to other features.

Specifically, as shown in FIGS. 8 to 9B, the transporting device 10 includes the first transport passage 12, the second transport passage 13, the transporting member 2A, and a force transmitter 55.

As shown in FIGS. 9A and 9B, the first transport passage 12 is provided as a linear output transport passage extending along a rotation axis of the photoconductor drum 61 at the base of the accommodation space in the housing 66*a* of the cleaning device 66. As shown in FIG. 9B, the passage space 12*a* of the first transport passage 12 has an upper opening and a cross-sectionally-semicircular base that is slightly tilted relative to the photoconductor drum 61.

The second transport passage 13 is connected to the first end 12*b* of the first transport passage 12 and is also connected to the collection container 57.

Furthermore, as shown in FIGS. 9A and 9B, the second transport passage 13 is constituted of three bent passage portions 14A, 14C, and 14D and a linear passage portion 13*s*.

The first bent passage portion 14A is bent downward from the first end 12*b* of the first transport passage 12. The second bent passage portion 14C is bent diagonally upward toward the collection container 57 from the lower terminal end of the first bent passage portion 14A. The third bent passage portion 14D is bent toward a side surface of the collection container 57 from the terminal end of the linear passage portion 13*s*. The linear passage portion 13*s* is inclined and extends linearly to connect the terminal end of the second bent passage portion 14C and the initial end of the third bent passage portion 14D.

The transporting member 2A is identical to the transporting member 2A according to the first exemplary embodiment (see FIGS. 2A to 5B) and includes the first transporting section 23, the second transporting section 26, and the drive section 31.

Furthermore, similar to the case of the transporting device 1A according to the first exemplary embodiment (see FIG. 1), the transporting member 2A is used by disposing the second transporting section 26 in the first transport passage 12 of the transporting device 10 and disposing the first transporting section 23 in the second transport passage 13 of the transporting device 10.

The force transmitter 55 transmits a rotational force to the transporting member 2A at an outer portion 66*d* of the second end 12*c* of the first transport passage 12 in the transporting device 10.

The force transmitter 55 is substantially similar to the force transmitter 15 in the transporting device 1A according to the first exemplary embodiment. The force transmitter 55 is provided separately from the first transport passage 12 and the second transport passage 13 and is disposed in the housing 51 of the image forming apparatus 5.

Figure 10:
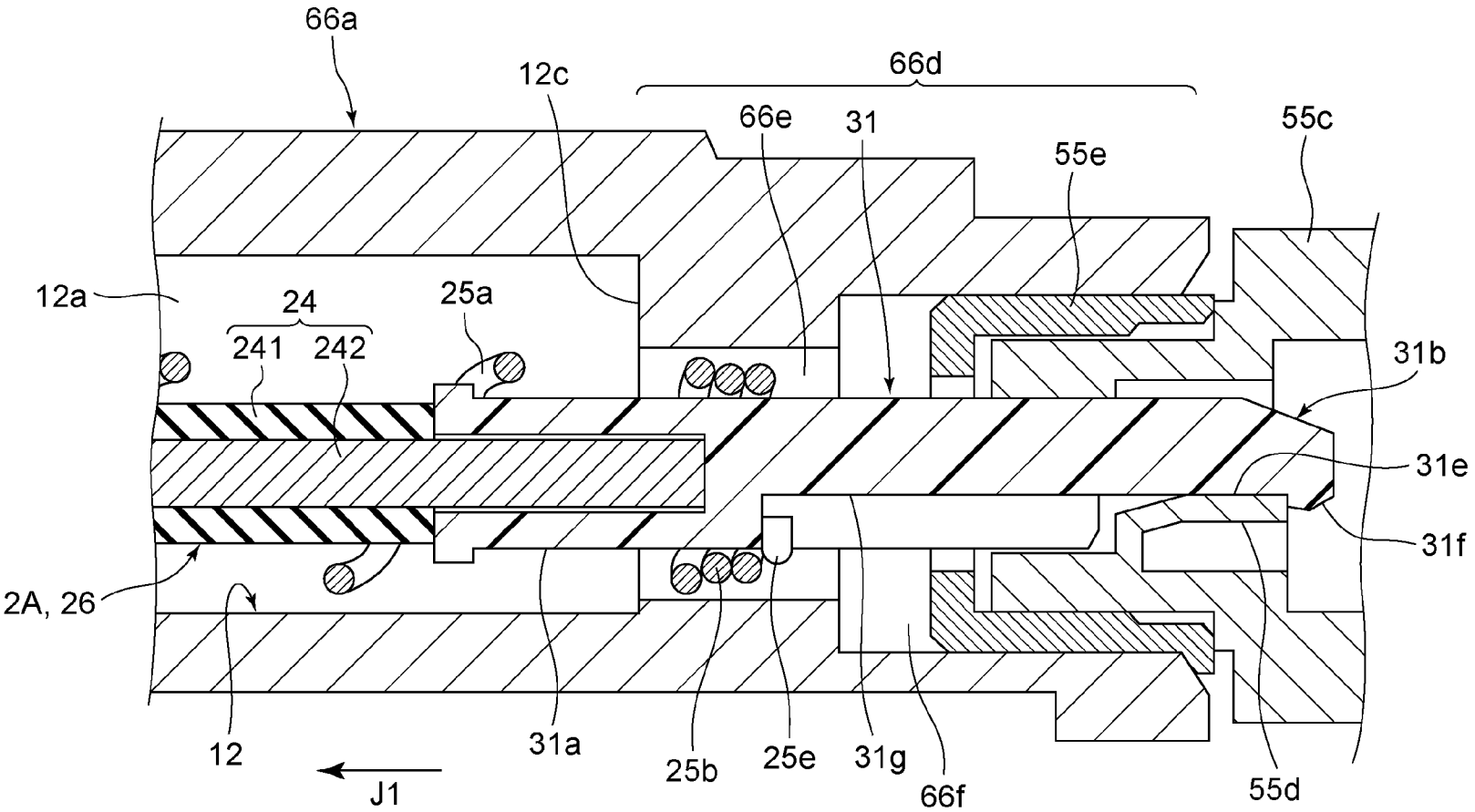
FIG. 10 is a cross-sectional view of an area including a transporting member in the transporting device in FIGS. 9A and 9B.

As shown in FIG. 10, in the transporting device 10, the first end 25*b* of the coil 25 of the second transporting section 26 in the transporting member 2A is secured to the drive section 31 of the transporting member 2A at the outer portion 66*d* extending continuously from the second end 12*c* of the first transport passage 12.

The outer portion 66*d* is provided as a part of the housing 66*a* of the cleaning device 66. The outer portion 66*d* has therein a cylindrical first space 66*e* and a cylindrical second space 66*f* with an opening at the outer end thereof.

The first space 66*e* is a cylindrical accommodation space through which the drive section 31 and the first end 25*b* of the coil 25 extend, and has an inner diameter that is smaller than the second end 12*c* of the first transport passage 12.

The second space 66*f* is a space that extends from an end of the first space 66*e* opposite the second end 12*c* of the first transport passage 12 and through which the joint 31*b* of the drive section 31 extends. The second space 66*f* is a cylindrical space with a diameter larger than that of the first space 66*e*. Moreover, the second space 66*f* is a space in which a shaft coupling 55*c* of the force transmitter 55 is fitted.

Accordingly, as shown in FIGS. 9B and 10, the first end 25*b* of the coil 25 of the transporting member 2A is secured to the drive section 31 in the first space 66*e* of the outer portion 66*d* extending continuously from the second end 12*c* of the first transport passage 12.

FIG. 10 illustrates a state where the drive section 31 is joined to the shaft coupling 55*c* of the force transmitter 55.

A slide bearing 55*e* fitted in the second space 66*f* of the outer portion 66*d* is attached to the outer peripheral surface of a small diameter portion at the distal end of the shaft coupling 55*c* of the force transmitter 55. The center of the small diameter portion at the distal end of the shaft coupling 55*c* is provided with a space that receives the joint 31*b* of the drive section 31 and is also provided with a locking portion 55*d* that is locked by being engaged with the lock portion 31*e* of the joint 31*b*.

Accordingly, when the drive section 31 of the transporting member 2A is to be attached to the attachment section of the housing 51 of the image forming unit 50, the drive section 31 is joined to the shaft coupling 55*c* by engaging the locking portion 55*d* of the shaft coupling 55*c* of the force transmitter 55 with the lock portion 31*e*. In this case, the locking portion 55*d* is locked in a state where the locking portion 55*d* is hooked to the protrusion 31*f* of the lock portion 31*e* at the joint 31*b* of the drive section 31.

Furthermore, as shown in FIG. 9B, in the transporting device 10, the first transporting section 23 having flexibility in the transporting member 2A is disposed within the three bent passage portions 14A, 14C, and 14D of the second transport passage 13.

Figure 11:
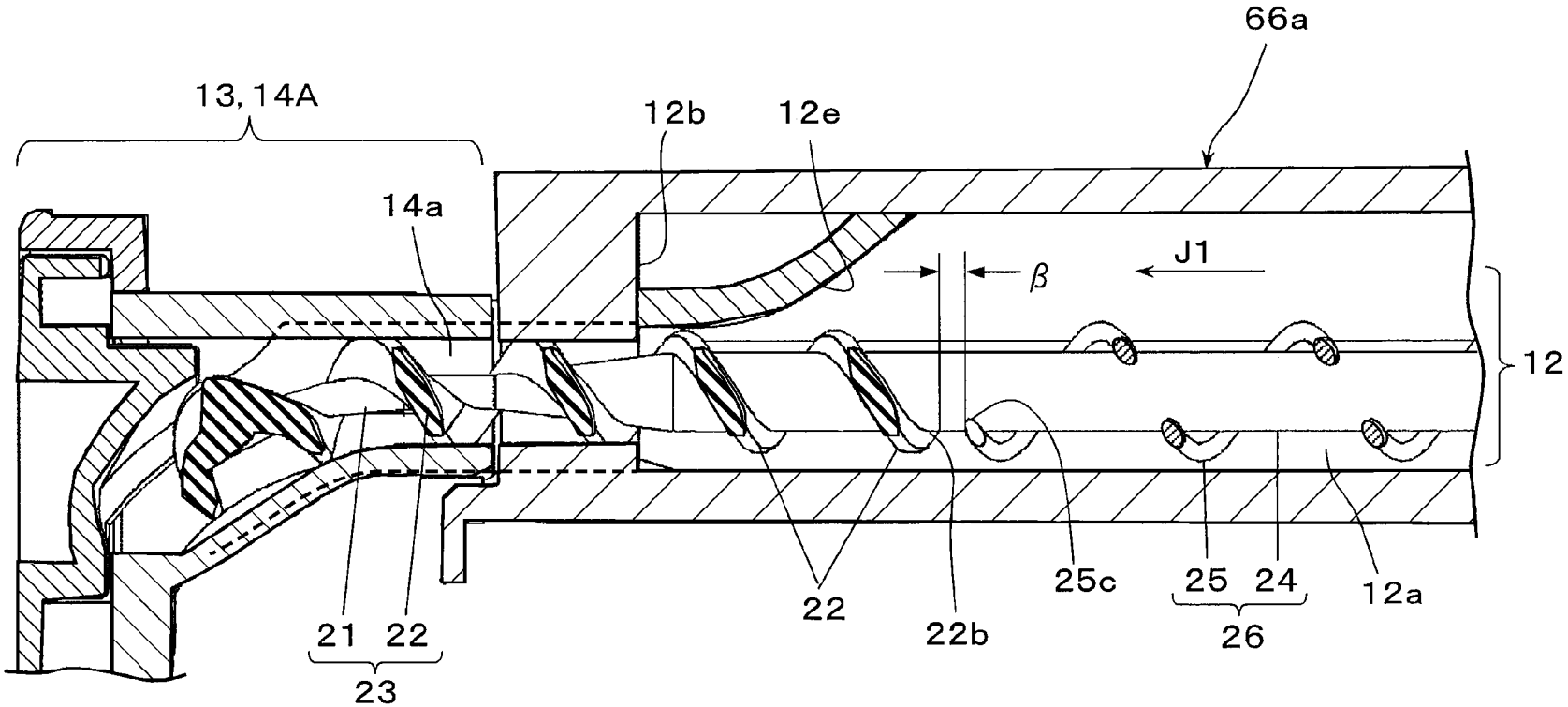
FIG. 11 is a cross-sectional view of another area including the transporting member in the transporting device in FIGS. 9A and 9B.

As shown in FIG. 11, the first transporting section 23 in the first bent passage portion 14A is disposed to slightly extend further upstream (inward) in the transporting direction J2 relative to the first end 12*b* of the first transport passage 12. In detail, in the first transporting section 23, the upstream end 22*b* of the blade 22 adjacent to the second transporting section 26 is disposed to slightly extend into the passage space 12*a* of the first transport passage 12. The upstream end 22*b* of the blade 22 shown in FIG. 11 extends into the passage space 12*a* by about 1.5 times the helical pitch of the blade 22.

The first bent passage portion 14A is connected to the first end 12*b* of the first transport passage 12 by a passage space 14*a* having a small outer diameter. The actual inner diameter of the passage space 14*a* is indicated with a dashed line in FIG. 11.

The first end 12*b* of the first transport passage 12 is provided with the guide surface 12*e* along which a transport object 19A, such as excess toner, to be transported through the passage space 12*a* of the first transport passage 12 in the transporting direction J1 by the second transporting section 26 is guided so that the transport object 19A is readily introduced to the passage space 14*a* of the first bent passage portion 14A in the second transporting section 26.

The transporting device 10 is equipped in the image forming apparatus 5 as a result of the image forming unit 50 being attached to the housing 51 of the image forming apparatus 5.

When the image forming unit 50 is to be attached, the drive section 31 of the transporting member 2A in the transporting device 10 is joined to the shaft coupling 55*c* of the force transmitter 55, as shown in FIG. 10.

Furthermore, the transporting device 10 operates in synchronization with driving of the image forming section 60 at a driving timing of, for example, an image forming operation.

At this driving timing, the cleaning device 66 in the image forming section 60 uses the contact member 66*b* to remove the transport object 19A, such as excess toner, from the bearing surface 61*a* of the photoconductor drum 61 and accommodates the transport object 19A within the housing 66*a*.

When the aforementioned driving timing is reached, the transporting device 10 activates the force transmitter 55 to input a rotational force to the transporting member 2A.

Accordingly, in the transporting device 10, a rotational force acting in a predetermined direction is input from the force transmitter 55 to the transporting member 2A via the drive section 31. Moreover, in the transporting member 2A, the drive section 31 is rotationally driven in accordance with the rotational force, and the input rotational force is transmitted from the drive section 31 to the second shaft 24 in the second transporting section 26 and is subsequently transmitted from the second shaft 24 to the first shaft 21 in the first transporting section 23.

As a result, in the transporting device 10, the transporting member 2A starts rotating in the predetermined direction, and at the same time, the first transporting section 23 and the second transporting section 26 starts transporting the transport object 19A.

Specifically, in the transporting device 10, the transport object 19A, such as excess toner, removed by the contact member 66*b* of the cleaning device 66 and existing in the first transport passage 12 within the housing 66*a* is transported through the first transport passage 12 in the transporting direction J1 by the second transporting section 26 of the transporting member 2A, so as to be delivered to the second transport passage 13. Furthermore, in the transporting device 10, the transport object 19A delivered from the first transport passage 12 is transported through the second transport passage 13 in the transporting direction J2 by the first transporting section 23 of the transporting member 2A.

Ultimately, in the transporting device 10, the transport object 19A, such as excess toner, transported by the first transporting section 23 is delivered outward from the outlet 13*e* located at the terminal end of the second transport passage 13, so as to be accommodated in the collection container 57.

When the transport object 19A is to be transported by the transporting device 10, the rotational force input from the drive section 31 in the transporting member 2A is transmitted from the drive section 31 to the second shaft 24 having higher rigidity than the first shaft 21, and is subsequently transmitted from the second shaft 24 to the first shaft 21 having flexibility.

Therefore, the transporting member 2A is similar to the transporting member 2A in the transporting device 1A according to the first exemplary embodiment in that the rotational force input from the drive section 31 may be efficiently transmitted to the first transporting section 23 and the second transporting section 26.

Furthermore, in this case, in the transporting member 2A, the first transporting section 23 receiving the rotational force rotates within the passage space 13*a* in the three bent passage portions 14A, 14C, and 14D of the second transport passage 13.

Because the rotational force is also efficiently transmitted to the first transporting section 23, the transporting member 2A rotates in a state where the first shaft 21 having flexibility in the first transporting section 23 is bent within the passage space 13*a* in the bent passage portions 14A, 14C, and 14D, and also rotates while the blade 22 having flexibility elastically deforms to conform to the bent first shaft 21.

Therefore, in the transporting device 10, the rotational force input from the drive section 31 may be efficiently transmitted to the first transporting section 23 and the second transporting section 26 of the transporting member 2A, so that transporting forces may be favorably obtained by the first transporting section 23 and the second transporting section 26, whereby a stable transporting force of the transporting member 2A may be obtained. Consequently, the transport object 19A, such as excess toner, may be favorably transported from the cleaning device 66 serving as the transport source toward the collection container 57 serving as the transport destination.

In this transporting device 10, effects substantially similar to those achieved by the transporting device 1A according to the first exemplary embodiment may be achieved.

Moreover, the transporting device 10 may further achieve the following effects.

When the first transport passage 12 in the cleaning device 66 is inevitably reduced in size due to limitations caused by size reduction of the image forming apparatus 5, for example, if a transporting device 100 shown in FIG. 19 as a comparative example is employed, the following problems may occur. Specifically, the transporting device 100 is equipped with a transporting member 200 in which the first transporting section 23 having flexibility is disposed not only in the first transport passage 12 but also in the second transport passage 13.

In this case, it is difficult to increase the outer diameter (i.e., the height from the shaft) of the blade 22 of the first transporting section 23 for increasing the transport capacity. Therefore, it gradually becomes difficult for the transport rate of the first transporting section 23 of the transporting member 2A to keep up with the flow rate of the transport object 19A, such as excess toner, removed by the contact member 66*b* of the cleaning device 66 and accommodated in the housing 66*a*. Thus, the first transport passage 12 becomes completely filled with the transport object 19A, causing the transport object 19A to aggregate easily. When the first transport passage 12 becomes completely full, the housing 66*a* of the cleaning device 66 also starts to become full as a result of accommodating the transport object 19A too much. The transport object 19A starting to aggregate in this full state pushes the contact member 66*b* toward the photoconductor drum 61 from inside the housing 66*a*, as indicated by an arrow F.

As a result, in the cleaning device 66, the contact state (i.e., orientation) of the contact member 66*b* with the bearing surface 61*a* of the photoconductor drum 61 is disturbed, thus causing the removal performance of the contact member 66*b* to deteriorate. Hence, the excess toner may pass underneath the contact member 66*b*, thus resulting in a cleaning defect.

In contrast, in the transporting device 10, the second transporting section 26 having the coil 25 of the transporting member 2A is disposed in the first transport passage 12 in the cleaning device 66.

Accordingly, in the first transport passage 12 in the cleaning device 66, the coil 25 in the second transporting section 26 of the transporting member 2A moves toward and away from the surface of the second shaft 24, so that the transport object 19A, such as excess toner, in the first transport passage 12 may be transported while being crumbled by vibration.

As a result, in the transporting device 10, the transport object 19A may be favorably transported without completely filling not only the first transport passage 12 but also the second transport passage 13. Accordingly, in the cleaning device 66, an occurrence of the aforementioned cleaning defect may also be avoided.

Third Exemplary Embodiment

Figure 12:
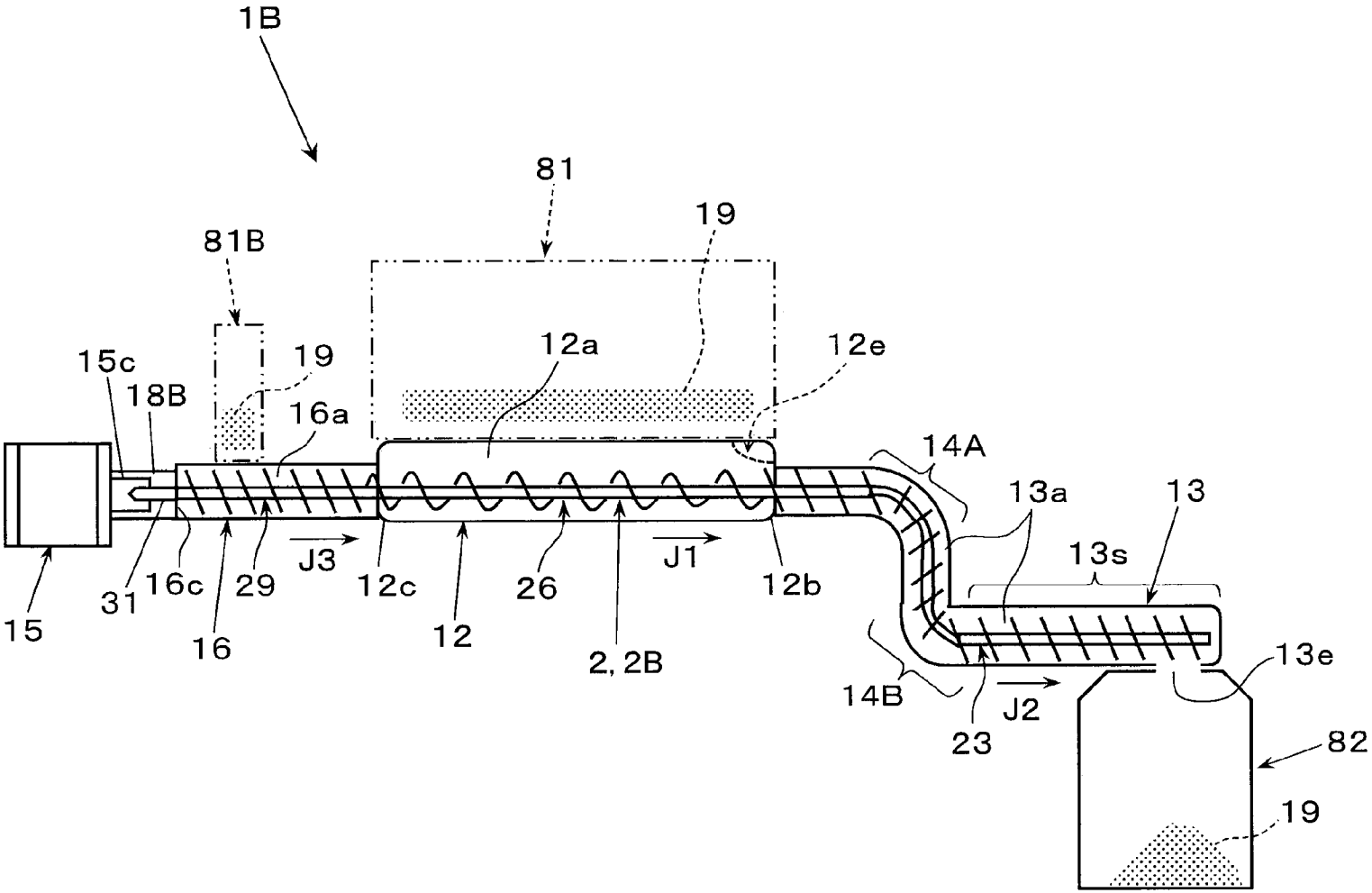
FIG. 12 schematically illustrates a transporting device according to a third exemplary embodiment.
Figure 13:
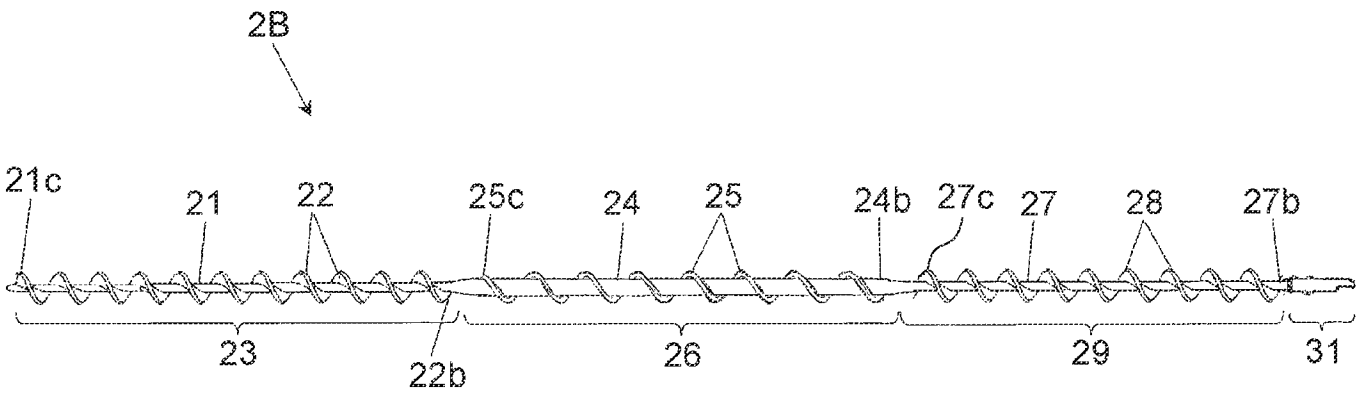
FIG. 13 is an external view of a transporting member according to the third exemplary embodiment.

FIG. 12 schematically illustrates a transporting device 1B according to a third exemplary embodiment of the disclosure. FIG. 13 is an external view of a transporting member 2B according to the third exemplary embodiment as a different example of the transporting member 2 used in the transporting device 1B.

As shown in FIG. 12, the transporting device 1B includes the first transport passage 12, the second transport passage 13, a third transport passage 16, the transporting member 2 that transports the transport object 19 at the transport source from the third transport passage 16 to the transport destination via the first transport passage 12 and the second transport passage 13, and the force transmitter 15 that transmits a rotational force to the transporting member 2.

The first transport passage 12, the second transport passage 13, and the force transmitter 15 are substantially identical to the first transport passage 12, the second transport passage 13, and the force transmitter 15 in the transporting device 1A (see FIG. 1) according to the first exemplary embodiment.

The third transport passage 16 is a passage in which a passage space 16*a* thereof extends linearly.

The third transport passage 16 is also a passage extended from an end of the first transport passage 12 opposite the second transport passage 13. Therefore, the third transport passage 16 may be regarded as an extended passage provided upstream of the first transport passage 12 in the transporting direction J1.

Similar to the first transport passage 12, for example, the third transport passage 16 is a tubular passage in which the passage space 16*a* is substantially circular in cross section orthogonal to the transporting direction, or is a passage with a trough-like lower section in which the passage space 16*a* has a substantially semicircular cross-sectionally lower portion and a cross-sectionally upper portion with an upper opening.

The third transport passage 16 is provided in a structural body 81B, such as a device or a container, serving as a transport source where the transport object 19 exists. In this case, the third transport passage 16 is provided inside an area where the transport object 19 is collected in the structural body 81B, or is externally connected to the structural body 81B. On the other hand, the first transport passage 12 is provided with the structural body 81, as described in the first exemplary embodiment. Therefore, the structural body 81B may be regarded as a structural body disposed upstream of the structural body 81.

The transporting member 2 in the transporting device 1B is disposed continuously through the third transport passage 16, the first transport passage 12, and the second transport passage 13 and transports the transport object 19 in that state to the receptor 82 serving as a predetermined transport destination.

In the transporting device 1B, the transporting member 2B having the following configuration is used as the transporting member 2.

For example, as shown in FIGS. 12 and 13, the transporting member 2B includes the first transporting section 23, the second transporting section 26, a third transporting section 29, and the drive section 31.

The first transporting section 23, the second transporting section 26, and the drive section 31 are substantially identical to the first transporting section 23, the second transporting section 26, and the drive section 31 of the transporting member 2A (see FIGS. 2A to 5B) according to the first exemplary embodiment.

For example, as shown in FIG. 13, the third transporting section 29 has a third shaft 27 having higher rigidity than the first shaft 21 and a second blade 28 that exists helically on the surface of the third shaft 27 and that transports the transport object 19.

The third shaft 27 extends from the end 24*b* of the second shaft 24 opposite the first shaft 21 and has higher rigidity than the first shaft 21.

The third shaft 27 according to the first exemplary embodiment is similar to the second shaft 24 (see FIG. 2B) of the transporting member 2A in that the third shaft 27 is constituted of a surface layer 241 composed of the same material as the first transporting section 23 and a core 242 disposed inside the surface layer 241 and having higher rigidity than the first shaft 21.

The second blade 28 extends helically at a predetermined pitch and a predetermined helix angle so as to exhibit a transporting function. The second blade 28 is substantially similar to the blade 22 of the transporting member 2A except for some configurations, such as dimensions.

The second blade 28 has a dimension compatible with a dimension of the passage space 16*a* in the third transport passage 16 where the third transporting section 29 is disposed. Furthermore, for example, as shown in FIG. 12, when the transporting member 2B rotates in a predetermined direction, the second blade 28 is configured such that the transporting direction for the transport object 19 is aligned with a direction indicated by an arrow J3.

For example, as shown in FIG. 13, the coil 25 in the second transporting section 26 is attached in a state where the first end 25*c* opposite the first transporting section 23 is secured to an end 27*c*, located toward the second shaft 24, of the third shaft 27 in the third transporting section 29 within the passage space 16*a* of the third transport passage 16. For example, the first end 25*c* of the coil 25 is secured by being fitted and retained at the center of the interior of the third shaft 27 serving as an attachment destination.

Furthermore, similar to the coil 25 of the transporting member 2A according to the first exemplary embodiment, the second end 25*c* of the coil 25 located adjacent to the first transporting section 23 is not secured to the second shaft 24.

Moreover, the drive section 31 is attached to an end 27*b*, located opposite the second shaft 24, of the third shaft 27 in the third transporting section 29.

Figure 14:
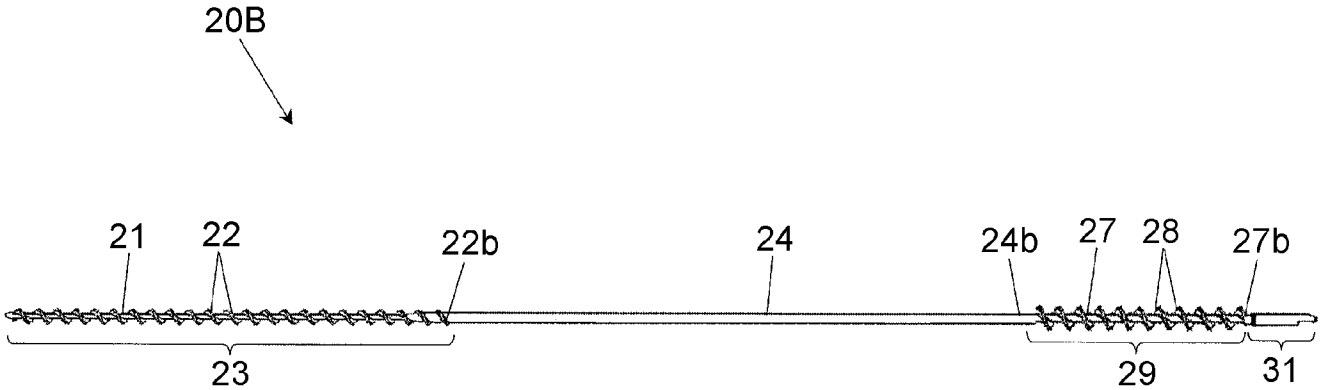
FIG. 14 is an external view of another transporting member according to the third exemplary embodiment.

FIG. 14 illustrates a transporting member 20B that may be used for fabricating the transporting member 2B.

The transporting member 20B is obtained by removing the coil 25 from the transporting member 2B.

Specifically, the transporting member 20B includes the first transporting section 23 having the first shaft 21 and the blade 22 and also having flexibility, the second shaft 24 having higher rigidity than the first shaft 21, the third transporting section 29 that has the third shaft 27 connected to the end 24*b* of the second shaft 24 opposite the first shaft 21 and having higher rigidity than the first shaft 21 and that also has the second blade 28, and the drive section 31 attached to the end 27*b* of the third shaft 27 opposite the second shaft 24.

In this case, the first shaft 21, the blade 22, the second shaft 24, the third shaft 27, the second blade 28, and the drive section 31 in the transporting member 20B are identical to the first shaft 21, the blade 22, the second shaft 24, the third shaft 27, the second blade 28, and the drive section 31 in the transporting member 2B described above.

The transporting member 20B may be used for fabricating the transporting member 2B by attaching the coil 25 of the transporting member 20B around the second shaft 24. Therefore, the transporting member 20B may be regarded as an intermediate product used for fabricating the transporting member 2B.

The transporting member 20B may also be used as a normal transporting member that utilizes the transporting force of the first transporting section 23 and the third transporting section 29.

As shown in FIG. 12, the transporting member 2B having the above-described configuration is used by being disposed in the transporting device 1B.

In this case, the transporting member 2B is used by disposing the second transporting section 26 in the first transport passage 12, disposing the second transport passage 13 in the first transporting section 23, and disposing the third transporting section 29 in the third transport passage 16.

In order to achieve this, the second transporting section 26 of the transporting member 2B is given a size suitable for being disposed within the passage space 12*a* of the first transport passage 12. Moreover, the first transporting section 23 is given a size suitable for being disposed within the passage space 13*a* of the second transport passage 13. Furthermore, the third transporting section 29 is given a size suitable for being disposed within the passage space 16*a* of the third transport passage 16.

The transporting member 2B is used by joining the drive section 31 to the shaft coupling 15*c* of the force transmitter 15 in the transporting device 1A at an outer portion 18B of a second end 16*c* of the third transport passage 16.

In this case, the drive section 31 is disposed in a state where substantially the entire drive section 31 is accommodated in the outer portion 18B at the second end 16*c* of the third transport passage 16. In this state, the drive section 31 is joined by connecting the joint 31*b* to the shaft coupling 15*c* of the force transmitter 15 and engaging the lock portion 31*e* of the joint 31*b* with a locking portion (not shown) of the shaft coupling 15*c* (see FIG. 10).

When the transport object 19 is to be transported in the transporting device 1B, the force transmitter 15 is actuated.

Accordingly, in the transporting device 1B, a rotational force acting in a predetermined direction is input from the force transmitter 15 to the transporting member 2B via the drive section 31. Consequently, in the transporting member 2B, the drive section 31 starts to rotate in accordance with the rotational force. In addition, the rotational force is transmitted from the drive section 31 to the second shaft 24 of the second transporting section 26, is subsequently transmitted from the second shaft 24 to the first shaft 21 of the first transporting section 23, and is further transmitted from the first shaft 21 to the third shaft 27 of the third transporting section 29.

As a result, in the transporting device 1B, the transporting member 2B starts to rotate in the predetermined direction, and at the same time, the first transporting section 23, the second transporting section 26, and the third transporting section 29 start to transport the transport object 19.

Specifically, as shown in FIG. 12, in the transporting device 1B, the transport object 19 existing in the structural body 81B serving as an upstream transport source is transported through the third transport passage 16 in the transporting direction J3 by the third transporting section 29 of the transporting member 2B, and is ultimately delivered toward the first transport passage 12. Moreover, in the transporting device 1B, the transport object 19 delivered from the third transport passage 16 is transported through the first transport passage 12 in the transporting direction J1 by the second transporting section 26 of the transporting member 2B, and is ultimately delivered toward the second transport passage 13. Furthermore, in the transporting device 1B, the transport object 19 delivered from the first transport passage 12 is transported through the second transport passage 13 in the transporting direction J2 by the first transporting section 23 of the transporting member 2B.

Finally, in the transporting device 1B, the transport object 19 transported by the first transporting section 23 is delivered from the outlet 13*e* located at the terminal end of the second transport passage 13 so as to be accommodated in the receptor 82.

In this case, in the transporting member 2B, the rotational force input from the drive section 31 is transmitted from the drive section 31 to the third shaft 27 and the second shaft 24 having higher rigidity than the first shaft 21, and is subsequently transmitted from the second shaft 24 to the first shaft 21 having flexibility.

Therefore, in the transporting member 2B, the rotational force may be efficiently transmitted to the first transporting section 23, the second transporting section 26, and the third transporting section 29, as compared with a case where the rotational force is input from the first shaft 21 of the first transporting section 23.

Furthermore, in this case, the transporting member 2B is similar to the transporting member 2A in that the first transporting section 23 receiving the rotational force rotates within the passage space 13*a* in the two bent passage portions 14A and 14B of the second transport passage 13.

Therefore, in the transporting device 1B, the rotational force input from the drive section 31 may be efficiently transmitted to the first transporting section 23, the second transporting section 26, and the third transporting section 29 of the transporting member 2B, so that transporting forces may be favorably obtained by the first transporting section 23, the second transporting section 26, and the third transporting section 29, whereby a stable transporting force of the transporting member 2B may be obtained. Consequently, the transport object 19 may be favorably transported from the transport source toward the transport destination.

In this transporting device 1B, effects substantially similar to those achieved by the transporting device 1A according to the first exemplary embodiment may be achieved.

Fourth Exemplary Embodiment

Figure 15:
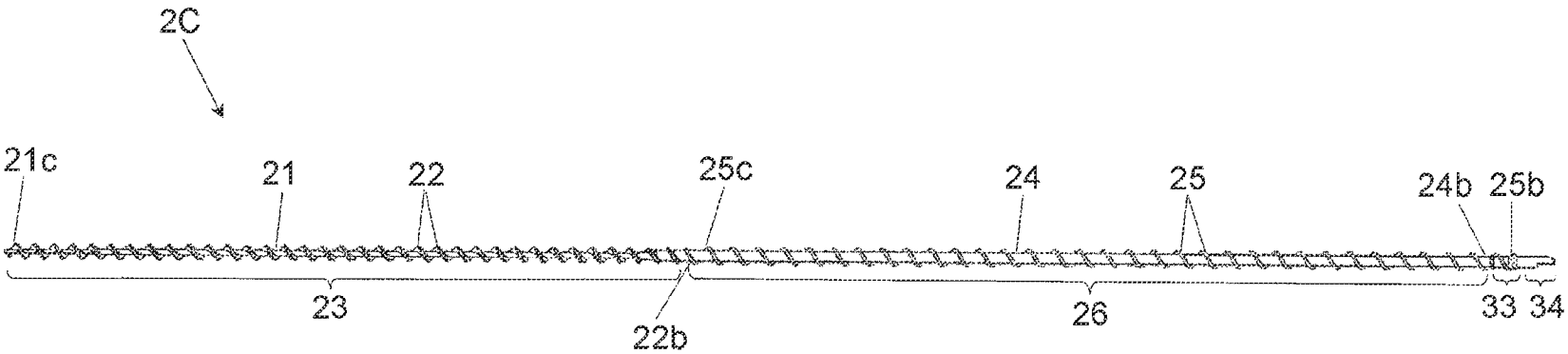
FIG. 15 is an external view of a transporting member according to a fourth exemplary embodiment.
Figure 16A:
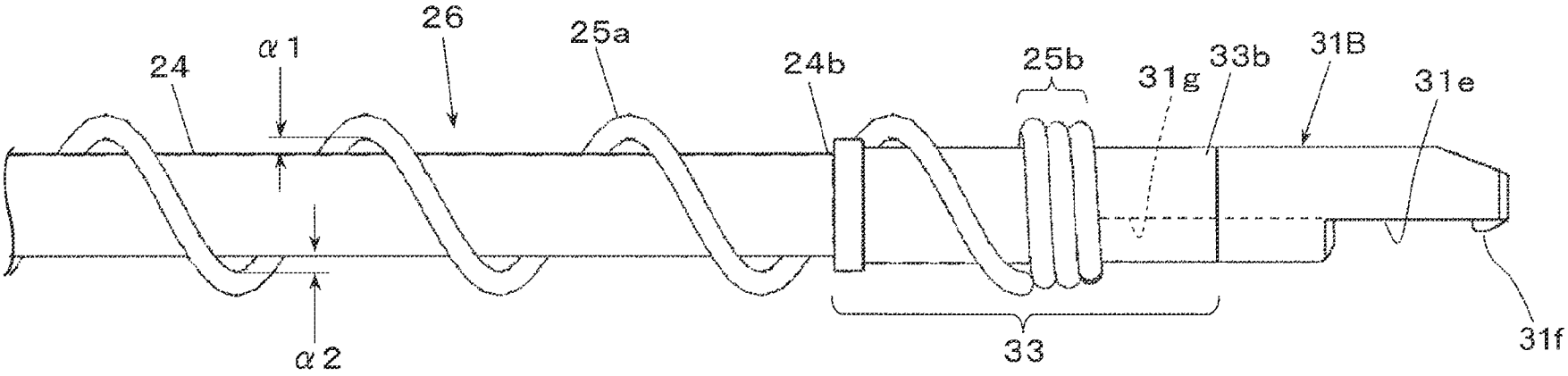
FIG. 16A is an external view of a part of the second transporting section and a drive section of the transporting member in FIG. 15.
Figure 16B:
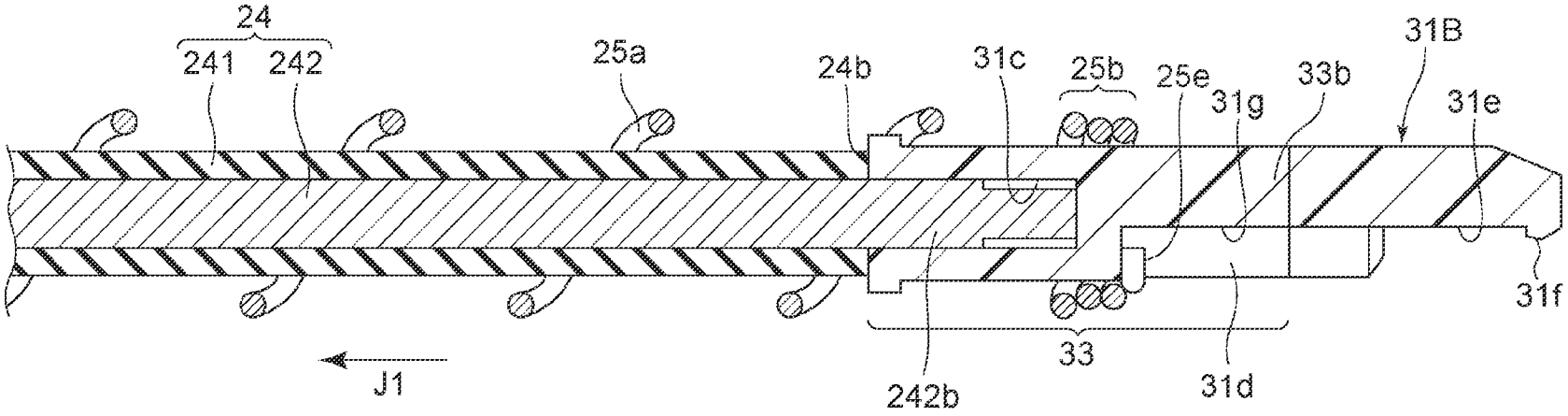
FIG. 16B is a cross-sectional view of the area in FIG. 16A.

FIG. 15 is an external view of a transporting member 2C according to a fourth exemplary embodiment of the disclosure. FIGS. 16A and 16B are an external view and a cross-sectional view, respectively, of a part of the transporting member 2C.

The transporting member 2C is different from the transporting member 2A according to the first exemplary embodiment in that the transporting member 2C is equipped with an end member 33, but is substantially similar to the transporting member 2A with regard to other features.

Specifically, the transporting member 2C is equipped with the end member 33 that is secured to the end 24*b* of the second shaft 24 and that serves as a third shaft connected to the end 24*b* of the second shaft 24 opposite the first shaft 21. The end member 33 has higher rigidity than the first shaft 21.

In the transporting member 2C, a drive section 31B is continuously secured to an end 33*b* of the end member 33 opposite the second shaft 24, and the first end 25*b* of the coil 25 is secured to the end member 33.

The end member 33 is provided with the groove 31*g* to be used for receiving and retaining the terminal end 25*e* at the first end 25*b* of the coil 25.

The drive section 31B is substantially identical to the drive section 31 (see FIGS. 4A and 4B) of the transporting member 2A. Specifically, the drive section 31B has the shaft 31*a* and the joint 31*b*. Moreover, the drive section 31B has higher rigidity than the first shaft 21.

In the fourth exemplary embodiment, the end member 33 and the drive section 31B are fabricated by integral molding using the same material. Therefore, even though the transporting member 2C has the end member 33 and the drive section 31B, since the two are an integral structure, the number of components and the number of assembly steps may be reduced, as compared with a case where the two are separate components. Alternatively, the end member 33 and the drive section 31B may be separate components and be joined to each other.

The transporting member 2C may be used in place of the transporting member 2A by being disposed in the transporting device 1A according to the first exemplary embodiment.

The end member 33 and the drive section 31B according to the fourth exemplary embodiment may be used in place of the drive section 31 of the transporting member 2B according to the second exemplary embodiment.

Modifications

In each of the transporting members 2A, 2B, and 2C according to the first, third, and fourth exemplary embodiments, the second shaft 24 of the second transporting section 26 is constituted of the surface layer 241 and the core 242. Alternatively, as shown in FIGS. 17A and 17B representatively illustrating the transporting member 2A, the second shaft 24 of the second transporting section 26 may be a second shaft 24B fabricated using a material having higher rigidity than the first shaft 21 of the first transporting section 23.

Figure 17A:
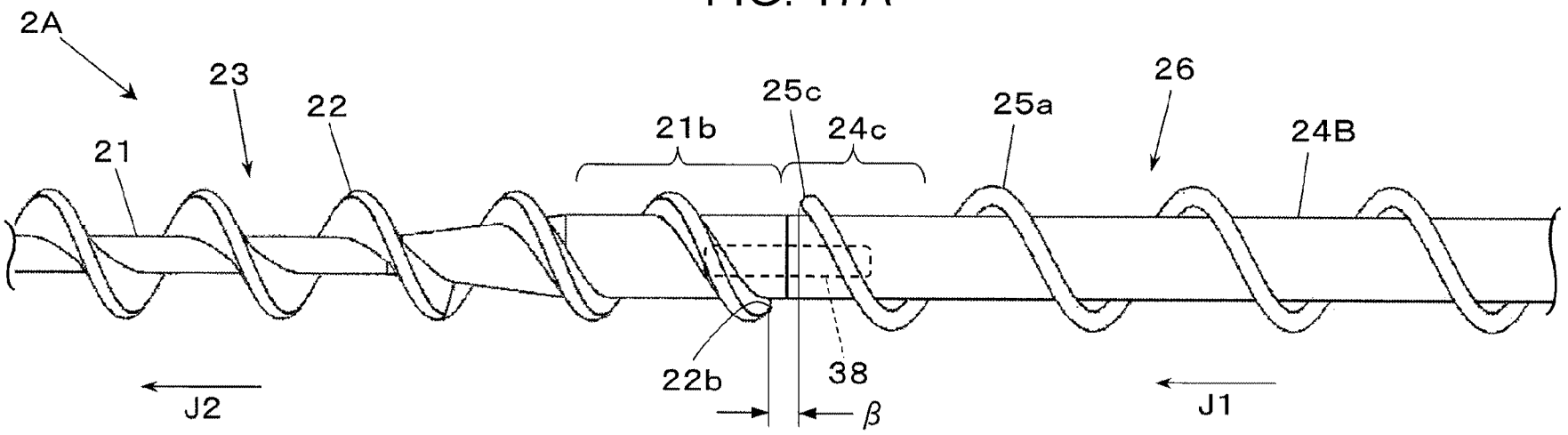
FIG. 17A is an external view of a part of a transporting member according to a modification.
Figure 17B:
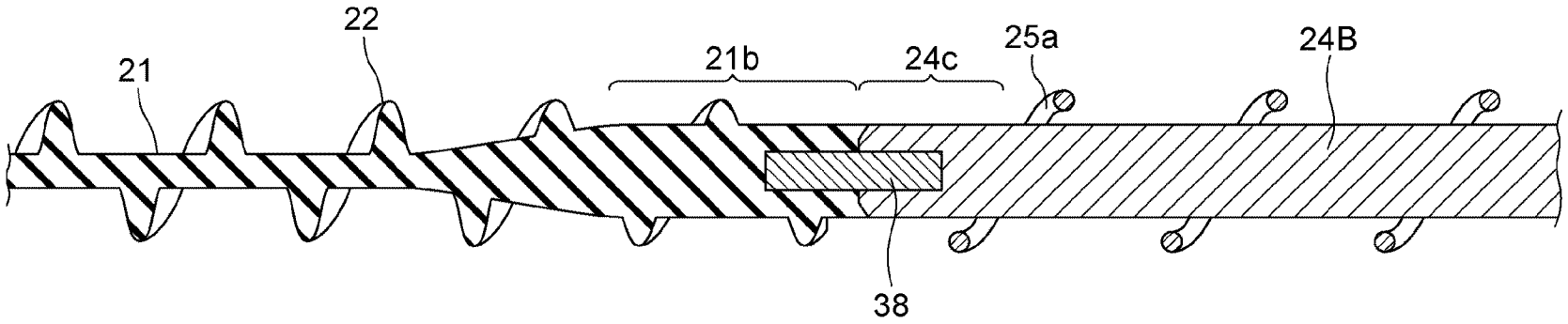
FIG. 17B is a cross-sectional view of the part in FIG. 17A.

In the representative transporting member 2A equipped with the second shaft 24B, the second shaft 24B may be joined to the first shaft 21 having flexibility by, for example, connecting the shafts 24B and 21 to each other in a state where a joint core 38 is fitted to the center of the shafts 24B and 21, as shown in FIGS. 17A and 17B. A terminal end 24*c* of the second shaft 24B is connected to the first end 21*b* of the shaft 21.

As mentioned above, in the transporting member 2A, the second end 25*c* of the coil 25 may be disposed out of contact with the upstream end 22*b* of the blade 22 of the first transporting section 23 in the transporting direction J2 (see FIGS. 3A and 3B). For example, as shown in FIGS. 18A and 18B, another example of such a transporting member may be a transporting member 2D in which the second end 25*c* of the coil 25 is disposed to slightly extend further downstream in the transporting direction J2, i.e., the axial direction, relative to the upstream end 22*b* of the blade 22.

Figure 18A:
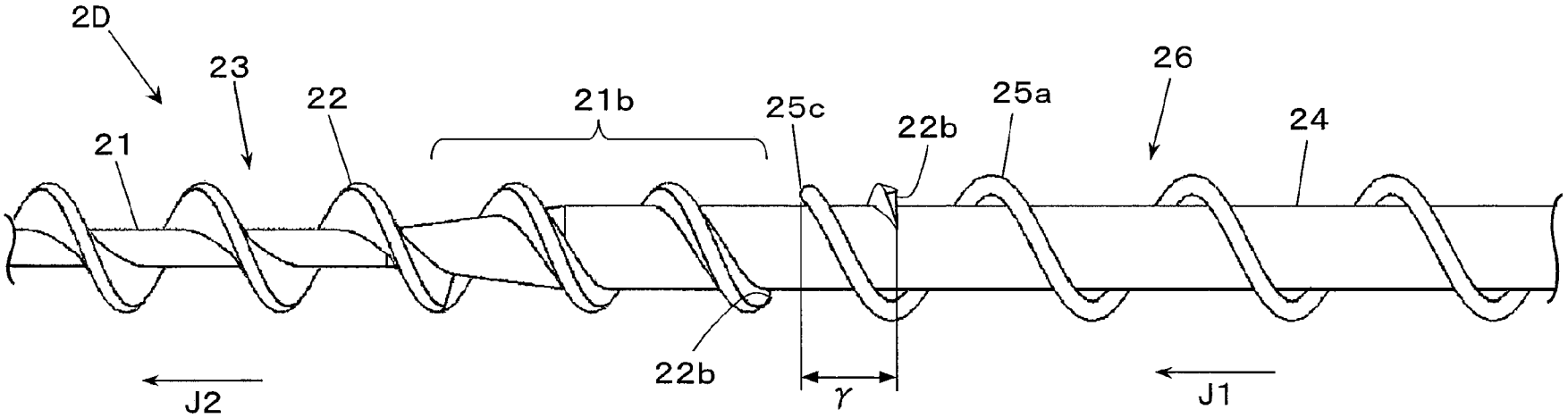
FIG. 18A is an external view of a part of a transporting member according to another modification.
Figure 18B:
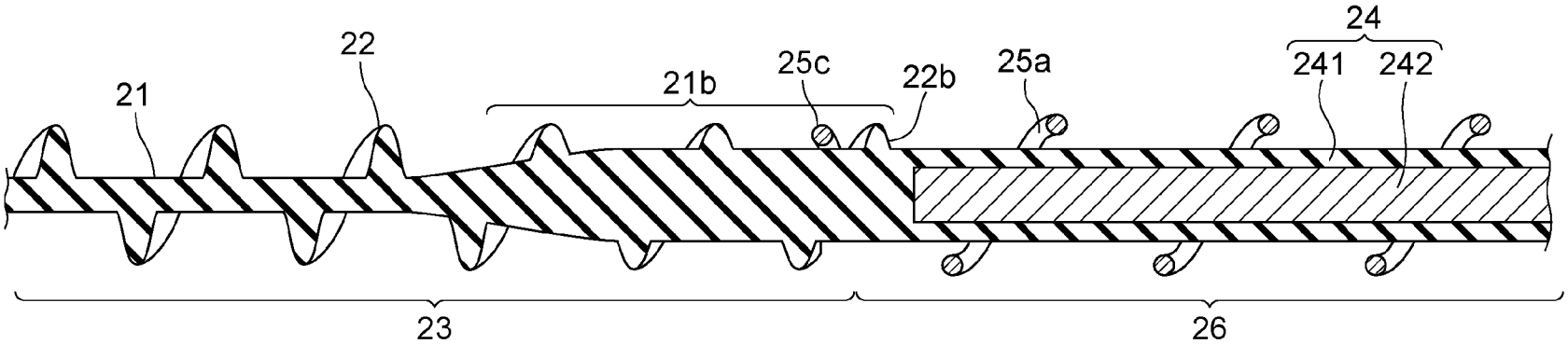
FIG. 18B is a cross-sectional view of the part in FIG. 18A.

The transporting member 2D shown in FIGS. 18A and 18B is an example where the second end 25*c* of the coil 25 is disposed to extend further downstream in the transporting direction J2 by a distance 7 relative to the upstream end 22*b* of the blade 22. For example, the distance 7 is a dimension smaller than about one helical pitch.

The transporting device 1A according to the first exemplary embodiment may be configured as follows.

Specifically, in the transporting device 1A, the first end 25*b* of the coil 25 may be secured to the end 24*b* of the second shaft 24 instead of the drive section 31 at the outer portion 18 of the second end 12*c* of the first transport passage 12.

Furthermore, in a case where the transporting member 2A equipped with the end member 33 and the drive section 31B according to the fourth exemplary embodiment is used in the transporting device 1A, the first end 25*b* of the coil 25 may be secured to the end member 33 instead of the drive section 31B at the outer portion 18 of the second end 12*c* of the first transport passage 12.

In each of the transporting device 1A according to the first exemplary embodiment and the transporting device 1B according to the third exemplary embodiment, a removal device similar to the cleaning device 66 according to the second exemplary embodiment may be used as the structural body 81 that provides the first transport passage 12.

The removal device has a contact member that removes the transport object 19 from the surface of a rotating structural body by coming into contact with the surface, and also has a housing provided with an accommodation space for accommodating the transport object 19 removed by the contact member. In the case where this removal device is used, the first transport passage 12 may be provided within the accommodation space in the removal device, similar to the case of the cleaning device 66.

The transporting device 1A according to the first exemplary embodiment and the transporting device 1B according to the third exemplary embodiment are not limited to a case where the devices are applied to the image forming apparatus 5, and may alternatively be applied to various types of apparatuses in which the transport object 19 is to be transported from a transport source to a transport destination.

The image forming section 60 used in an image forming apparatus equipped with the transporting device 1A may alternatively be an intermediate-transfer-type image forming section that uses a belt-type intermediate transfer member having a transfer surface as another example of an image bearing surface to which a toner image on the bearing surface 61*a* of the photoconductor drum 61 is temporarily transferred before being transferred onto the sheet-like object 9.

In the case of the image forming apparatus equipped with such an intermediate-transfer-type image forming section, a cleaning device is used for cleaning the transfer surface of the intermediate transfer member by removing the transport object 19A, such as excess toner, from the transfer surface. Therefore, in the image forming apparatus in this case, the transporting device 1A may be a transporting device equipped with an intermediate-transfer-member cleaning device as the structural body 81 serving as a transport source for the transport object 19A, such as excess toner.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transporting member comprising:

a first transporting section that has flexibility and has a first shaft and a blade existing helically on a surface of the first shaft and transporting a transport object;

a second transporting section that has a second shaft extending from a first end of the first shaft and having higher rigidity than the first shaft, and that also has a coil existing helically on a surface of the second shaft and movable toward and away from the surface of the second shaft, the coil transporting the transport object; and a drive section that is attached to an end of the second shaft opposite the first shaft or to a third shaft having higher rigidity than the first shaft by being connected to the end, the drive section being driven by receiving a rotational force.

2. The transporting member according to claim 1, wherein a first end of the coil is secured to the drive section.

3. The transporting member according to claim 1, wherein the third shaft is an end member that is secured to the end of the second shaft opposite the first shaft, wherein the drive section is continuously secured to an end of the end member opposite the second shaft, and wherein a first end of the coil is secured to the drive section or the end member.

4. The transporting member according to claim 1, further comprising:

a third transporting section that has the third shaft and a second blade existing helically on a surface of the third shaft and transporting the transport object, wherein the drive section is attached to an end of the third shaft opposite the second shaft, and wherein a first end of the coil is secured to the second shaft or the third shaft.

5. The transporting member according to claim 1, wherein the second shaft is constituted of a surface layer composed of a material identical to a material of the first transporting section and a core disposed inside the surface layer and having higher rigidity than the first shaft.

6. The transporting member according to claim 2, wherein a second end of the coil is not secured to the second shaft.

7. The transporting member according to claim 6, wherein the second end of the coil is disposed out of contact with an upstream end of the blade of the first transporting section in a transporting direction.

8. The transporting member according to claim 3, wherein the drive section and the end member are an integral structure.

9. A transporting device comprising:

a linear first transport passage;

a second transport passage that is connected to a first end of the first transport passage and that has at least one bent passage portion;

a transporting member that is disposed continuously through the first transport passage and the second transport passage and that transports a transport object from the first transport passage to a transport destination via the second transport passage; and a force transmitter that transmits a rotational force to the transporting member at an outer side of a second end of the first transport passage, wherein the transporting member includes the transporting member according to claim 1 and is used by disposing the second transporting section in the first transport passage and disposing the first transporting section in the second transport passage.

10. The transporting device according to claim 9, wherein a first end of the coil in the transporting member is secured to the drive section, the end of the second shaft opposite the first shaft, or an end member at a portion extending continuously outward from a second end of the first transport passage.

11. An image forming apparatus comprising:

an image bearing member that has a bearing surface retaining an image composed of a developer;

a cleaning device that cleans the bearing surface of the image bearing member by removing the developer adhered to the bearing surface;

a container that accommodates the developer removed by the cleaning device; and a transporting device that transports the developer removed by the cleaning device to the container via a linear first transport passage and a second transport passage, the first transport passage transporting the developer, the second transport passage being connected to a first end of the first transport passage and having at least one bent passage portion, wherein the transporting device includes the transporting device according to claim 9.

12. A transporting member comprising:

a first transporting section that has flexibility and has a first shaft and a blade existing helically on a surface of the first shaft and transporting a transport object;

a second transporting section that has a second shaft extending from a first end of the first shaft and having higher rigidity than the first shaft, and that also has a coil having an inner coil diameter larger than an outer diameter of the second shaft and transporting the transport object; and a drive section that is attached to an end of the second shaft opposite the first shaft or to a third shaft having higher rigidity than the first shaft by being connected to the end, the drive section being driven by receiving a rotational force.

13. The transporting member according to claim 12, wherein a first end of the coil is secured to the drive section.

14. The transporting member according to claim 12, wherein the third shaft is an end member that is secured to the end of the second shaft opposite the first shaft, wherein the drive section is continuously secured to an end of the end member opposite the second shaft, and wherein a first end of the coil is secured to the drive section or the end member.

15. The transporting member according to claim 12, further comprising:

a third transporting section that has the third shaft and a second blade existing helically on a surface of the third shaft and transporting the transport object, wherein the drive section is attached to an end of the third shaft opposite the second shaft, and wherein a first end of the coil is secured to the second shaft or the third shaft.

16. A transporting member comprising:

a first transporting section that has flexibility and has a first shaft and a blade existing helically on a surface of the first shaft and transporting a transport object;

a second shaft to which a coil that transports the transport object is attachable, the second shaft extending from a first end of the first shaft and having higher rigidity than the first shaft; and a drive section that is attached to an end of the second shaft opposite the first shaft or to a third shaft having higher rigidity than the first shaft by being connected to the end, the drive section being driven by receiving a rotational force.

17. The transporting member according to claim 16, wherein the third shaft is an end member secured to the end of the second shaft opposite the first shaft, and wherein the drive section is secured to an end of the end member opposite the second shaft.

18. The transporting member according to claim 16, further comprising:

an additional transporting section that has the third shaft and a second blade existing helically on a surface of the third shaft and transporting the transport object, wherein the drive section is attached to an end of the third shaft opposite the second shaft.

19. The transporting member according to claim 16, wherein the second shaft is constituted of a surface layer composed of a material identical to a material of the first transporting section and a core disposed inside the surface layer and having higher rigidity than the first shaft.

20. The transporting member according to claim 17, wherein the drive section and the end member are an integral structure.

* * * * *